United States Patent [19]

Sakanoue et al.

[11] 4,032,349

[45] June 28, 1977

[54] HIGH MOLECULAR WEIGHT MERCAPTO COMPOUND IN COLOR DIFFUSION TRANSFER PROCESSING COMPOSITION

[75] Inventors: Seiki Sakanoue; Motohiko Tsubota; Yoshiharu Fuseya; Keiichi Adachi; Tadao Shishido, all of Minami-ashigara, Japan

[73] Assignee: Fuji Photo Film Co., Ltd., Minami-ashigara, Japan

[22] Filed: June 25, 1975

[21] Appl. No.: 590,523

[30] Foreign Application Priority Data

June 26, 1974 Japan ..... 49-72995

[52] U.S. Cl. ..... 96/77; 96/3; 96/29 D; 96/56

[51] Int. Cl.[2] ..... G03C 1/40; G03C 7/00; G03C 5/54

[58] Field of Search ..... 96/3, 29 D, 56, 66.3, 96/95, 77

[56] References Cited

UNITED STATES PATENTS

| | | | |
|---|---|---|---|
| 3,227,551 | 1/1966 | Barr et al. | 96/3 |
| 3,260,597 | 7/1966 | Weyerts et al. | 96/3 |
| 3,265,498 | 8/1966 | Rogers et al. | 96/3 |
| 3,295,976 | 1/1967 | Abbott et al. | 96/66.3 |
| 3,856,520 | 12/1974 | Bloom et al. | 96/3 |
| 3,930,864 | 1/1976 | Abel et al. | 96/3 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A color diffusion transfer photographic material which comprises: (a) a light-sensitive element containing at least one silver halide emulsion layer having a dye image-providing material associated therewith; (b) an image-receiving element capable of imagewise fixing the dye image-providing material as a result of exposure and development of the silver halide emulsion layer; and (c) a processing composition capable of causing development of the silver halide emulsion layer and containing a mercapto compound having a molecular weight of about 230 or higher; with at least one of the light-sensitive element, the image-receiving element and the processing composition containing a developing agent for the silver halide.

12 Claims, No Drawings

HIGH MOLECULAR WEIGHT MERCAPTO COMPOUND IN COLOR DIFFUSION TRANSFER PROCESSING COMPOSITION

BACKGROUND OF THE INVENTION

1. Field of the Invention

The present invention relates to a color diffusion transfer photographic material and, more particularly, to a silver halide color diffusion transfer photographic material capable of providing images having less stain.

2. Description of the Prior Art

Various systems for the color diffusion photographic process are known. For example, a process using dye developers as described in U.S. Pat. No. 2,983,606, a process using diffusible dyes produced by a reaction between a color former and an oxidation product as described in U.S. Pat. Nos. 3,227,550 and 3,227,551, and a process described in U.S. Pat. No. 3,628,952 or Japanese Patent Publication No. 10,240/59 are known. These processes possess in common the features that a dye image-providing material-containing silver halide emulsion layer and an image-receiving layer are used in combination, and that the silver halide emulsion layer is processed, after exposure, with an alkaline processing composition having a pH to transfer diffusible dyes to the image-receiving element. These photographic film units are designed so that the light-sensitive element is exposed using a self-processing camera and is then passed between a pair of pressure-applying members contained in the camera (for example, a pair of rollers or a slit having a structure capable of applying pressure) to thereby spread a processing solution on the exposed light-sensitive element and rapidly process the light-sensitive element, thus rapidly obtaining color positive images in the image-receiving element.

Since these film units require rapidity and handiness, the transferred images are not usually washed with water. Also, with film units comprising the image-receiving element and the light-sensitive layer which is not to be separated from the image-receiving element after transferring images, it is impossible to wash the transferred images with water. Therefore, stains result in the high light areas of the transferred images during storage or the transferred image colors darken deteriorating the photographic quality.

More specifically, for example, in the color diffusion transfer photographic process using dye developers, the spread processing composition permeates into an exposed light-sensitive element containing at least one silver halide emulsion initiating development and, as a result of the action thereof, the dye developers are oxidized and are immobilized in the developer areas.

This immobilization clearly depends in part upon the mobility or solubility of the oxidation product of the dye developers being less than that of the unoxidized dye developers. This immobilization is considered to also depend in part upon a localized reduction of the alkali concentration which is a function of development.

Since unreacted dye developers in the undeveloped areas of the emulsion are diffusible, an imagewise distribution of the diffusible unoxidized dye developers is formed as a function of the exposure and development of the silver halide emulsion. This imagewise distribution of the diffusible unoxidized dye developers is transfered, at least in part, to a superposed image-receiving element. In this transfer process, oxidized dye developers which are less mobile are clearly discriminated from unoxidized dye developers, and transferred images are formed on the image-receiving element as an image.

When an element containing silver halide emulsion layers with different light sensitivities, each emulsion layer being associated with a dye developer which is in a substantially complementary relation with the main light-sensitive regions of the emulsion, that is, when a red light-sensitive silver halide emulsion, a green-light-sensitive silver halide emulsion and a blue light-sensitive silver halide emulsion are associated, respectively, with a cyan dye developer, a magenta dye developer and a yellow dye developer, each dye developer is oxidized, upon processing the light-sensitive element containing these elements with a processing composition, in the exposed areas of the associated emulsion and becomes immobilized. The remaining dye developers in the unexposed areas are diffused and are transferred to the image-receiving material.

Therefore, when a large amount of unoxidized dye developers are distributed in the sufficiently exposed negative areas corresponding to the high light areas of a photographed object, the dye developers diffuse into the image-receiving material similarly with the unexposed dye developers present in the unexposed negative areas corresponding to the dark areas of the photographed object, resulting in indistinct transferred images having a high minimum density.

Even when used at a comparatively strong alkalinity of a pH of about 13, typical dye developers function as a weak silver halide developing agent. Therefore, when these dye developers are used, the expected maximum density, gradation and sensitivity cannot be obtained. Since immobilization of the dye developers is a function of the emulsion developing agent, the transferred images obtained in this process exhibit an undesirably high minimum density, a low maximum density and a low contrast in the high light areas. These results may be attributed in part to factors such as the developing activity of the dye developers as a silver halide-developing agent is weak, and that all of the dye developers surrounding the silver halide are not effectively utilized. In order to remove these defects, the use of auxiliary silver halide-developing agents such as 4'-methylphenylhydroquinone (e.g., as described in U.S. Pat. No. 3,039,869) and of development accelerators such as N-benzyl-α-picolinium bromide (e.g., as described in U.S. Pat. No. 3,173,786) has been suggested. However, the use of such compounds entails the disadvantage that the density in the high light areas of the transferred images is high, even though the undesirable high minimum density, the low maximum density and the low contrast of transferred images are removed to some extent. This defect is particularly serious with film units in which the image-receiving element need not be separated from the light-sensitive element after the completion of the image transfer.

That is, the density of the high light areas of the transferred images greatly influences the visual impression received, even when the density is small. The smaller is the absolute value of the density, the better. Also, the blue density is desirably not higher than the green density and the red density. The high light area of the images providing a high blue density causes the disadvantage of a yellowing phenomenon which is unattractive to image viewers.

Furthermore, the defect has been found that the colors of the transferred images formed by transferring part of the dye developers such as red, green, blue, yellow, magenta, cyan, etc. darken during storage with the lapse of time. This color darkening varies depending upon the conditions of storage. This is particularly serious with film units of the type in which the image-receiving element is to be separated from the light-sensitive element. Such undesirable density in high light areas and undesirable density resulting in the darkening of colors are called stain.

Where dye image-providing materials other than the above-described dye developers, such as are described in U.S. Pat. No. 3,443,441, German Patent Application OLS 2,230,014, U.S. Pat. Nos. 3,725,062, 3,728,113, Japanese Pat. No. (OPI) No. 33826/73, Japanese Patent Publication No. 32191/73, U.S. Pat. No. 3,245,789, German Patent Applications OLS No. 1,930,215, U.S. Pat. No. 3,443,940 and the like are used, similar stain occurs in the transferred images as long as the auxiliary silver halide-developing agent (U.S. Pat. No. 3,039,869) such as the above-described 4'-methylphenylhydroquinone is used in combination.

SUMMARY OF THE INVENTION

An object of the present invention is to provide a photographic product for preparing stain-free, excellent color images, utilizing diffusible dye image-providing materials.

Another object of the present invention is to provide a photographic product for preparing color transferred images with whiter high light areas.

A further object of the present invention is to provide a photographic product in which less darkening of the colors of the color transferred images occurs.

Still a further object of the present invention is to provide a photographic product having excellent color separation of the color transferred images.

The above-described objects of the present invention are attained with a color diffusion transfer photographic material which comprises (a) a light-sensitive element containing at least one silver halide emulsion layer having a dye image-providing material associated therewith, (b) an image-receiving element capable of imagewise fixing the dye image-providing material transferred from the light-sensitive element as a result of exposure and development, and (c) a processing composition capable of developing the silver halide emulsion layer, causing the transfer of the dye-image providing material, and containing a mercapto compound having a molecular weight of not less than about 230, preferably not less than 300.

DETAILED DESCRIPTION OF THE INVENTION

Mercapto compounds having a molecular weight of less than about 230 have such a strong controlling action on the silver halide than an apparent desensitization results, causing an unnecessary coloration in the high light areas of the transferred images. On the other hand, even polymer-type mercapto compounds exhibit a stain-preventing effect.

It is well known in the color diffusion transfer process field to use low molecular weight mercapto compounds (e.g., 1-phenyl-5-mercaptotetrazole, 2-mercaptobenzothiazole, etc.) as an anti-fogging agent in the processing composition. However, it was quite surprising that the objects of the present invention can be attained by incorporating mercapto compounds having a molecular weight of not less than about 230 in the processing composition. That is, it could not be expected that the development-inhibiting or restraining effect of such compounds not only is lost but also that marked stain-preventing effect could be achieved as well. The addition of 1-phenyl-5-mercaptotetrazole, 2-mercaptobenzothiazole or the like to the processing composition unavoidably entails a desensitization of the silver halide emulsion layers in the light-sensitive element and, in addition, the developing rate of the exposed silver halide emulsion layers is reduced so much that the density in the high light areas of the transferred images becomes unsatisfactorily high. Thus, the addition of low molecular weight mercapto compounds to the processing solution does not exhibit any effect in the prevention of stain of the high light areas and conversely provides unsatisfactory results, and unavoidably entails a desensitization of the emulsion layers.

On the other hand, mercapto compounds having a molecular weight of not less than about 230 in accordance with the present invention have the effect of preventing stain in the high light areas of the images and provide images having whiter high light areas substantially without any desensitization of the emulsion layers. The upper limit of the molecular weight of the mercapto compounds of the invention is not critical and in general mercapto compounds having molecular weights up to about 1,000 can be employed.

Thus low molecular weight mercapto compounds and the mercapto compounds of the present invention are different from each other in this respect.

The cause of stain is not clear. However, stain may be attributed to an oxidation product of the developing agent used. In particular, it has been found that, when a developing agent having a dihydroxyphenyl group and an unsubstituted carbon atom in the ortho position to at least one of the hydroxy groups (e.g., 4'-methylphenylhydroquinone, etc.) is used as an auxiliary developing agent, the causes of the stain include at least the following. Firstly, an oxidation product of the auxiliary developing agent, generated as a result of developing a silver halide emulsion, often appears yellow. Secondly, the hydroxyquinone derivatives produced by the reaction between the oxidation product of the auxiliary developing agent and the hydroxide ion present in an alkaline processing solution, the compound generated by the reaction with a nucleophilic agent present in the film unit (e.g., N-benzyl-$\alpha$-picolinium bromide) (this being part of the cause), and, in addition, the compounds generated by the reaction of the above-described compounds are generally colored. Therefore, a large amount of the above-described colored products are generated in the areas of the light-sensitive element corresponding to the developed areas of a silver halide emulsion. Part of these colored products are transferred to the image-receiving element together with the dye developers, whereas part of the remaining products are gradually transferred after transfer of dye developers. Also, an oxidation product of the auxiliary developing agent is produced not only as a result of the development of the silver halide emulsion but, in some cases, produced by oxygen in the air as well. In such case, the image colors of the dye developers in the transferred areas are darkened.

Another cause of stain results from the dye developers. When dye developers are used as a dye image-providing material, the transfer of dye developers can be substantially prevented by using the above-described auxiliary developing agents and/or development accelerators. In fact, however, a slight amount of an oxidation product of dye developers is transferred in many cases to an image-receiving element. This transfer of the oxidation product of the dye developer results in stain reducing the whiteness of the high light areas of images. Also, this transfer of the oxidation product deteriorates the color separation of the transferred images.

Also, examples of dye-image-providing materials include those described in U.S. Pat. No. 3,443,441, German Patent Application OLS No. 2,230,014, U.S. Pat. Nos. 3,725,062, 3,728,113, Japanese Patent Application OPI No. 33826/73, Japanese Patent Publication No. 32129/73 U.S. Pat. No. 3,245,789, German Patent Application OLS No. 1,930,215, U.S. Pat. No. 3,443,940, etc., in addition to the above-described dye developers. When these dye developers are used, similar stain will be generated as long as the silver halide developing agent (e.g., as described in U.S. Pat. No. 3,039,869) such as the above-described 4'-methylphenylhydroquinone is used in combination as a developing agent.

The formation of various stains as described above can be prevented according to the process of the present invention by using mercapto compounds having a molecular weight of about 230 or higher.

Preferred examples of the mercapto compounds of the present invention are those represented by the following general formulae (I) and (II) having a molecular weight of not less than about 230;

$$R^1 - SH \quad (I)$$

$$R^2 - SH \quad (II)$$

wherein $R^1$ represents an alkyl group having 14 to 32 carbon atoms (such as a tetradecyl group, a pentadecyl group, a hexadecyl group, etc.,) or an aralkyl group having 15 to 32 carbon atoms (such as an $\alpha$-phenylnonyl group), which can be substituted with a halogen atom (such as a fluorine atom, a chlorine atom, a bromine atom), a nitro group, a cyano group, an alkoxy group (such as a butoxydecyl group, etc.), an aryloxy group (such as a phenoxyoctyl group, etc.), or the like; $R^2$ represents a 3- to 6-membered carbon ring, a 3- to 6-membered heterocyclic ring containing at least one carbon atom and 1 to 5 atoms other than carbon atoms (e.g., an oxygen atom, a nitrogen atom, a sulfur atom, a selenium atom, etc.), or a B-A- group, in which the carbon ring or the heterocyclic ring may form a fused ring structure and can substituted with a halogen atom (e.g., fluorine atom, a chlorine atom, a bromine atom, etc.), a nitro group, a carboxy group, an aliphatic hydrocarbyl group having 1 to 32 carbon atoms (such as a straight or branched chain alkyl group or a cyclic aliphatic hydrocarbyl group, e.g., a methyl group, an ethyl group, a propyl group, an isopropyl group, a tert-amyl group, a cyclohexyl group, a dodecyl group, etc.), a monocyclic or bicyclic ring-fused aryl group having 6 to 32 carbon atoms (such as a phenylene group, a naphthalene group, etc.), an amido group having up to 32 carbon atoms (e.g., a butyramido group, a hexanamido group, a heptanamido group, a decanamido group, a dodecanamido group, etc.), a carbamoyl group having up to 32 carbon atoms (e.g., a butylcarbamoyl group, a hexylcarbamoyl group, etc.), an alkoxy group having up to 32 carbon atoms (e.g., a methoxy group, an ethoxy group, etc.), an aryloxy group having up to 32 carbon atoms (such as a phenoxy group, etc.), or the like. B represents the same alkyl group, aryl group, heterocyclic ring or the like as defined with respect to $R_1$ or $R^2$, and A represents a divalent group such as a carbonyl group, a thiocarbonyl group, a carboxymethylene group, or the like. And when A represents a carbonyl group or a thiocarbonyl group, $BR_2$ does not represent an amido group, a carbamoyl group or a carbonyl group.

Examples of carbon rings for $R^2$ include a cycloalkyl group (e.g., a cyclopropyl group, etc.), a cycloalkenyl group (e.g., a cyclopropenyl group, etc.), an aryl group (e.g., a phenyl group, a naphthyl group, an anthracenyl group, a chlorophenyl group, a cyanophenyl group, a carboxyphenyl group, a benzylphenyl group, an octoxyphenyl group, etc.), and the like. Examples of heterocyclic rings for $R^2$ include a furyl group, a benzofuranyl group, an oxazolyl group, a benzoxazolyl group, an isoxazolyl group, a benzoxazolyl group, an isoxazolyl group, an oxadiazolyl group, a pyranyl group, an oxathiathianyl group, a diazetyl group, a pyrrolyl group, an indolyl group, a carbazolyl group, a picolinyl group, an acridinyl group, an imidazolinyl group, a pyridyl group, a pyridazinyl group, a pyrimidinyl group, a pyrazinyl group, a quinoxalinyl group, a quinolinyl group, an isoquinolinyl group, a triazinyl group, a benzotriazinyl group a tetrazolyl group, a triazinethionyl group, a piperidinyl group a thiazolyl group, a benzothiazolyl group, a thiadiazolyl group, a selenazolyl group, a benzoselenazolyl group, etc.

Further, it should be emphasized that suitable examples of the above described $R^1$ and $R^2$ groups including substituents thereon are those which in combination with the -SH moiety result in the compounds of the general formula (I) and (II) having a molecular weight of about 230 or higher.

Particularly useful compounds which can be used in the present invention include the compounds represented by the following general formulae (III) to (IX)

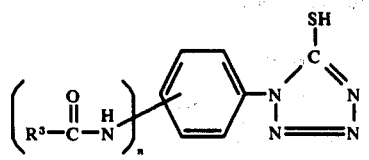
(III)

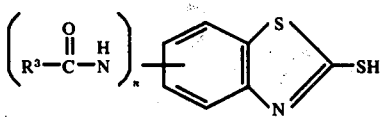
(IV)

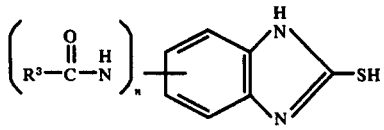
(V)

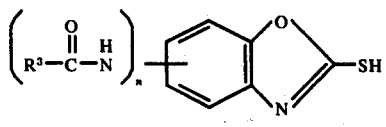
(VI)

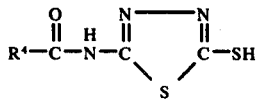
(VII)

-continued

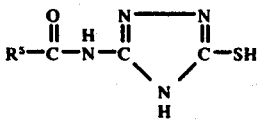

(VIII)

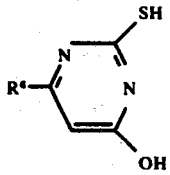

(IX)

wherein $R^3$ represents a hydrocarbyl group having 3 to 31 carbon atoms, preferably 5 to 15 carbon atoms; $R^4$ represents a hydrocarbyl group having 5 to 31 carbon atoms, preferably 7 to 17 carbon atoms; $R^5$ represents a hydrocarbyl group having 7 to 31 carbon atoms, preferably 9 to 19 carbon atoms; $R^6$ represents a hydrocarbyl group having 8 to 32 carbon atoms, preferably 10 to 20 carbon atoms, and *n* represents an integer of 1 to 5.

In the formulae (III) to (IX) above, the hydrocarbyl group can be a straight or branched chain alkyl group (e.g., a pentyl group, a heptyl group, a nonyl group, an undecyl group, a 2-methylpentyl group, etc.) or a cyclic aliphatic hydrocarbyl group (e.g., a cyclopropyl group, a cyclopentyl group, a cyclohexyl group, etc.), and can be substituted with an alkoxy group (e.g., a methoxy group, an ethoxy group, etc.), an aryl group (e.g., a phenyl group), an aryloxy group, etc. Furthermore, the hydrocarbyl group includes an aryl group (e.g., a phenyl group, a naphthyl group, a chlorophenyl group, etc.).

Typical examples of compounds which can be used in the present invention represented by the above-described general formulae are shown below, however, the present invention should not be construed as being limited to these compounds.

$CH_3(CH_2)_{13}SH$ (1)

$CH_3(CH_2)_{10}-CH(SH)-COOH$ (2)

(3)

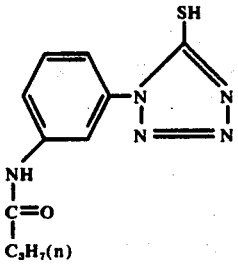

(4)

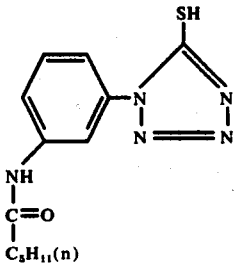

-continued (5)

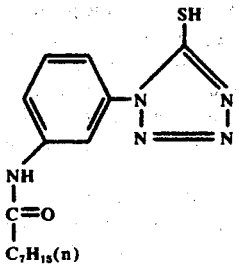

(6)

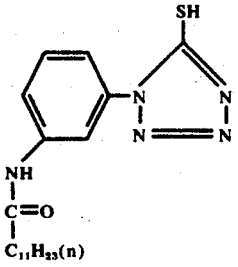

(7)

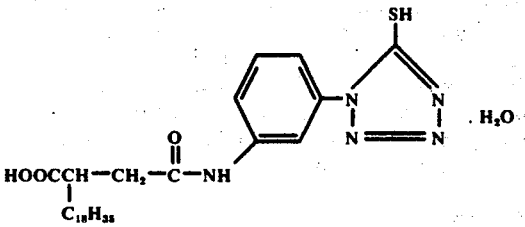

(8)

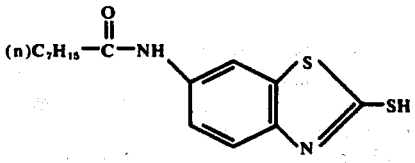

(9)

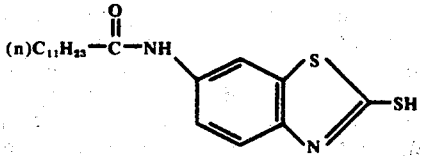

(10)

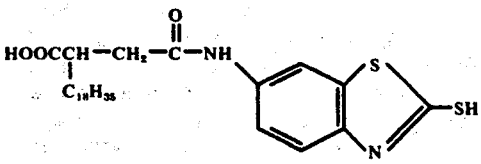

(11)

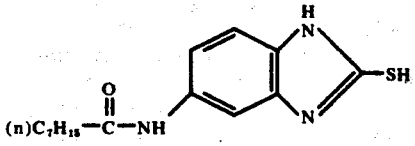

(12)

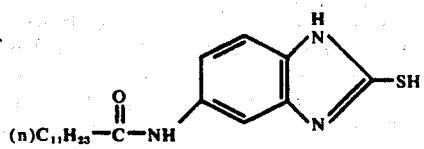

-continued (13)

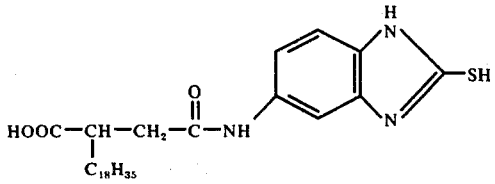

(14)

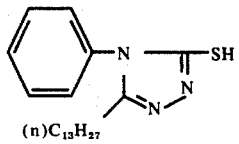

(15)

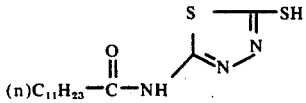

(16)

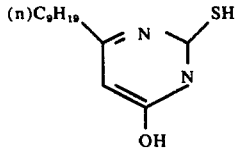

(17)

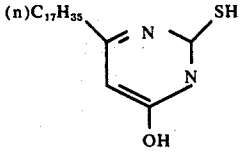

The effect of the compounds used in the invention to prevent stain is useful for compounds having a benzenoid developing agent group, i.e., an aromatic developing agent group capable of forming a quinoid structure upon oxidation (e.g., hydroquinone, catechol, p-aminophenol, p-phenylenediamine, or a like derivative) used as a developing agent of the silver halide emulsions contained in a light-sensitive element. This stain-preventing effect is particularly marked when compounds having a dihydroxyphenyl group and an unsubstituted carbon atom in an ortho position to at least one of the hydroxy groups are used as a developing agent.

The useful results obtained by the present invention are attributed, at least in part, to the conversion of the oxidation product of the benzenoid developing agent to a compound having low diffusibility in the processing composition by an addition reaction with the mercapto compound of the present invention and/or the production of a developing agent having a weak reducing power by this addition reaction.

When the mercapto compound used in the present invention is soluble in an alkaline aqueous solution, the compound can be added to the processing composition for incorporation therein at any stage during the preparation of the processing composition. When the mercapto compound is insoluble in an alkaline aqueous solution, the compound is preferably dispersed, after the addition thereof, in a hydrophilic polymer present in the processing composition. Suitable hydrophilic polymers include high molecular weight polyvinyl alcohol, hydroxyethyl cellulose, sodium carboxymethyl cellulose, etc. A high speed rotary mixer, a colloid mill, a high pressure homogenizer, etc. are effective for dispersion.

The compound of the present invention is suitably employed in an amount of from about 0.01 to 50 mols per 1 mol of the developing agent. A particularly preferable range is about 0.1 to 5 mols per 1 mol of the developing agent. The term "developing agent" as used herein includes compounds having a silver halide developing agent moiety.

Some of the advantageous effects of the present invention are enumerated below.

Firstly, stains due to the transfer of an oxidation product of the developing agent generated as a result of the development of a silver halide emulsion or a oxidation product generated as a result of the air oxidation of the developing agent can be prevented.

Secondly, stains caused by the reaction between an oxidation product of the benzenoid developing agent and a nucleophilic agent (e.g., N-benzyl-α-picolinium bromide, a nitrogen-containing saturated heterocyclic compound such as piperidine, piperadine, etc. are prevented.

Thirdly, formation of colored compounds by air oxidation of the processing composition (e.g., N-benzyl-α-picolinium bromide, etc.) can be prevented.

As a result, transferred images having excellent high light area whiteness and excellent color separation can be obtained. Further, transferred images in which less generation of stain upon storage with the lapse of time and images darkening of color occur can be obtained. The effect of the use of the compound of the present invention is remarkable particularly with film units of the type in which the image-receiving element need not be separated from the light-sensitive element after image transfer.

Nucleophilic agents reacting with an oxidation product of the developing agent include well known compounds having a methylene group or groups active in an alkaline aqueous solution, such as N-benzyl-α-picolinium bromide described in U.S. Pat. No. 3,173,786. In addition, illustrative examples include active methylene and active methine compounds described in U.S. Pat. No. 3,502,468 (e.g., α-cyanoacetophenone, etc.), pyridine compounds having a hydroxy group or an amino group described in U.S. Pat. No. 3,578,447 (e.g., 2-hydroxy-3-cyano-4-methyl-6-undecylpyridine, etc.), neutral or negatively charged nitrogen-containing saturated heterocyclic compounds described in Japanese Patent Application No. 43,295/74 (e.g., piperidine, etc.), and the like.

The dye developers which can be used in the present invention are compounds which possess both a dye structure moiety and a silver halide-developing group in the same molecule as described in U.S. Pat. No. 2,983,606. The light absorption of the dye developer is advantageously that which enables color based on subtractive color photography to be reproduced, i.e., that which provides yellow, magenta or cyan colors. The dye structure moieties which provide such absorptions can be derived from azo dyes, anthraquinone dyes, phthalocyanine dyes, nitro dyes, quinoline dyes, azomethine dyes, indamine dyes, indoaniline dyes, indophenol dyes, azine dyes, etc.

On the other hand, the silver halide-developing group, represents a group capable of developing light-struck silver halide, preferably, represents a group in which the hydrophilic character is lost as a result of oxidation. In general, a benzenoid developing group, i.e., an aromatic developing group which, upon being oxidized, forms a quinoid structure, is suitable. A preferred developing group is a hydroquinonyl group.

Illustrative examples of other suitable developing groups, are an o-dihydroxyphenyl group, an o- and p-amino-substituted hydroxyphenyl group, and the like. In preferred dye developers, the dye structure moiety and the developing group are interrupted from each other by a saturated aliphatic group such as an ethylene group which prevents electronic conjugation. In particular, a 2-hydroquinonylethyl group and a 2-hydroquinonylpropyl group are useful. The dye structure moiety and the developing group can be connected to each other through a coordinate bond as described in U.S. Pat. Nos. 3,551,406, 3,563,739, 3,597,200 and 3,674,478, as well as a covalent bond. Furthermore, for some end-use purposes and in some diffusion transfer color photographic material structures, it is advantageous to reduce the dye structure moiety to thereby temporarily convert the dye structure moiety to a colorless leuco form as described in U.S. Patent 3,320,063, or to acylate the hydroxyl group or amino group of the auxochrome to thereby temporarily shift the absorption to a shorter wave-length side as described in U.S. Pat. Nos. 3,230,085, 3,307,947, 3,579,334 and Japanese Patent Application No. 76,226/73. Dye developers having a dye structure moiety with a hydroxy group in the ortho position to the azo bond are useful in that they have excellent absorption characteristics and have excellent color image stability as described in U.S. Patent 3,299,041.

Other developers suitable for use in the present invention are dye developers, which are described in U.S. Pat. Nos. 2,983,605, 2,983,606, 2,992,106, 3,047,386, 3,076,808, 3,076,820, 3,077,402, 3,126,280, 3,131,061, 3,134,762, 3,134,765, 3,135,604, 3,135,605, 3,135,606, 3,135,734, 3,141,772, 3,142,565, 3,173,906, 3,183,090, 3,218,164, 3,230,082, 3,230,083, 3,230,086, 3,239,339, 3,245,790, 3,309,199, 3,246,985, 985, 3,320,063, 3,320,083, 3,347,672, 3,347,673, 3,453,107, 3,579,334, 3,482,972, and 3,563,739; Australian Pat. No. 220,279; German Pat. No. 1,036,640; British Pat. Nos. 804,971, 804,973, 804,974, and 804,975; Belgian Pat. Nos. 554,935 and 568,344; Canadian Pat. Nos. 579,038 and 577,021; French Pat. No. 1,168,292; etc.

The dye developers are characterized in that they are slightly soluble in water and non-diffusible under acidic and neutral conditions and they are diffusible under alkaline condition.

Representative examples of the dye developers include the following compounds.

1-Phenyl-3-N-n-hexylcarbamoyl-4-p-(2-hydroquinonylethyl)-phenylazo-5-pyrazolone
2-p-(2-Hydroquinonylethyl)-phenylazo-4-isopropoxy-1-naphthol
1,4-bis[β-(Hydroquinonyl-isopropyl)amino]-5,8-dihydroxyanthraquinone
1-Phenyl-3-n-butyl-carbamoyl-4-[p-(2′,5′-dihydroxyphenethyl)phenylazo]-5-pyrazolone
1-Phenyl-3-N-n-hexylcarbamoyl-4-[p-(2′,5′-dihydroxyphenethyl)phenylazo]-5-pyrazolone
1-Phenyl-3-carbethoxy-4- p-(2′,5′-dihyroxyphenethyl)-phenylazo -5-pyrazolone
2-[p-(2′,5′-Dihydroxyphenethyl)phenylazo]-4-isopropoxy-1-naphthol
1-Phenyl-3-N-cyclohexylcarbamoyl-4-[p-(2′,5′-dihydroxyphenethyl)-phenylazo]-5-pyrazolone
1-Phenyl-3-phenyl-4-[p-(2′,5′-dihyroxyphenethyl)-phenylazo]-5-pyrazolone
1-Phenyl-3-amido-4- ′-[p-(2″,5″-dihydroxyphenethyl)-phenylazo]-2′,5′-diethoxyphenylazo -5-pyrazolone
1-Phenyl-3-N-cyclohexylcarbamoyl-4-[p-(2′,5′-dihydroxyphenethyl)-phenylazo]-5-pyrazolone
1-Phenyl-3-phenyl-4-[p-(2′,5′-dihydroxyphenethyl)-phenylazo]-5-pyrazolone
1-Phenyl-3-methyl-4-[p-(2′,5′-dihydroxyphenethyl)-phenylazo]-5-pyrazolone
1-Phenyl-3-(N-n-heptyl)carbamoyl-4-[p-(β-hydroquinonylethyl)-phenlazo]-5-pyrazolone
1-(2′-Chlorophenyl)-3-(N-n-hexylcarbamoyl)-4-[p-(β-hydroquinonylethyl-phenylazo]-5-pyrazolone

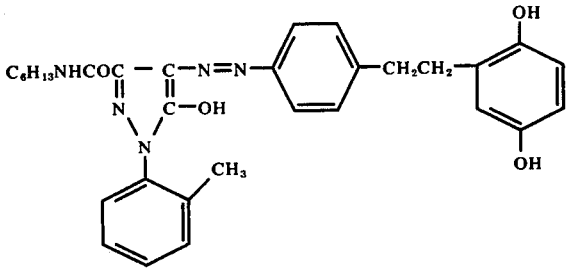

1-(2′-Methylphenyl)-3-(N-n-hexylcarbamoyl)-4-[p-(β-hydroquinonylethyl)-phenylzao]-5-pyrazolone
1-Acetoxy-2-[p-(β-hydroquinonylethyl)-phenylazo]-4-methoxy-naphthalene
4-Isobutoxy-2-[p-(β-hydroquinonylethyl)-phenylazo]-1-naphthol
2- 4′-[p-(2″,5″-Dihydroxyphenethyl)-phenylazo]-α-naphthylazo -4-methoxy-1naphthol
2- 4″-[p-(2″,5″-Dihyroxyphenethyl)-phenylazo]-α-napthylazo -4-methoxy-1-naphthol
4-[p-(2′,5′-Dihydroxyphenyl)-phenylazo]-5-acetamido-1-naphthol
4-[p-(2′,5′-Dihydroxyphenethyl)-phenylazo]-5-benzamido-1-naphthol
2-[p-(2′,5′-Dihydroxy-′-methylphenethyl)-phenylazo]-4-propoxy-1-naphthol
2-[p-(2′,5′-Dihyroxyphenethyl)-phenylazo]-4-acetamido-1-naphthol
2-[p-(2′,5′-Dihydroxyphenethyl)-phenylazo]-4-methoxy-1-naphthol
2-[p-(2′,5′-Dihydroxyphenethyl)-phenylazo]-4-ethoxy-1-naphthol
2-[p-(2′,5′-Dihydroxyphenethyl)-phenylazo]-4-n-propyl-1-naphthol

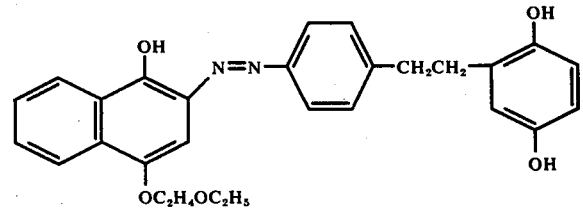

2-[p-(2′,5′-Dihyroxyphenethyl)-phenylazo]-4-[1″,-4″-dioxahexyl]-1-naphthol
1,4-bis[β-(2′,5′-Dihydroxphenyl)-ethylamino]anthraquinone
1-Chloro-4-[β-(2′,5′-dihydroxyphenyl)-ethylamino]anthraquinone
N-Monobenzoyl-1,4-bis[β-(3′,4′-dihydroxyphenyl)-ethylamino]-anthraquinone N-Monobenzoyl-1,4-bis[β-(2′,5′-dihydroxyphenyl)-ethylamino]-anthraquinone
5,8-Dihydroxy-1,4-bis[(β-hydroquinonyl-α-methyl)-ethyl-amino]-anthraquinone
1,4-bis(2′,5′-Dihydroxyaniline)anthraquinone
1,5-bis(2′,5′-Dihydroxyaniline)-4,8-dihydroxy-anthraquinone
1,4-bis[(β-Hydroquinonyl-α-ethyl)ethylamino]-anthraquinone
5-Hydroxy-1,4-bis[(β-hydroquinonyl-α-methyl)-ethylamino]-anthraquinone
1-(β-Hydroxy-α-ethyl-ethylamino)-4-(β-hyroquinonyl-α-methyl-ethylamino)-anthraquinone
1-(Butanol-2′-amino)-5,8-dihydroxy-4-hydroquinonyl-isopropylamino-anthraquinone

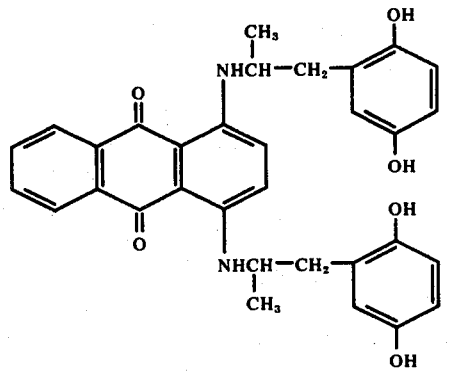

1,4-bis[β-(2′,5′-Dihydroxyphenyl)-isopropylamino]-anthraquninone

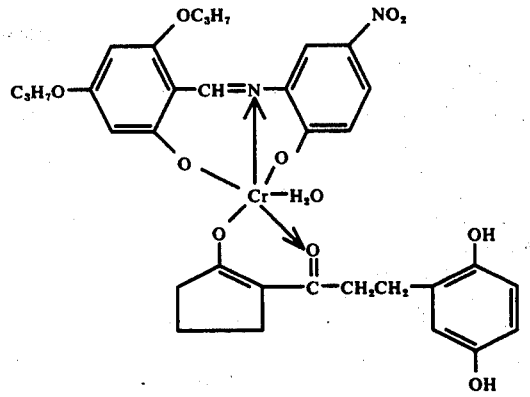

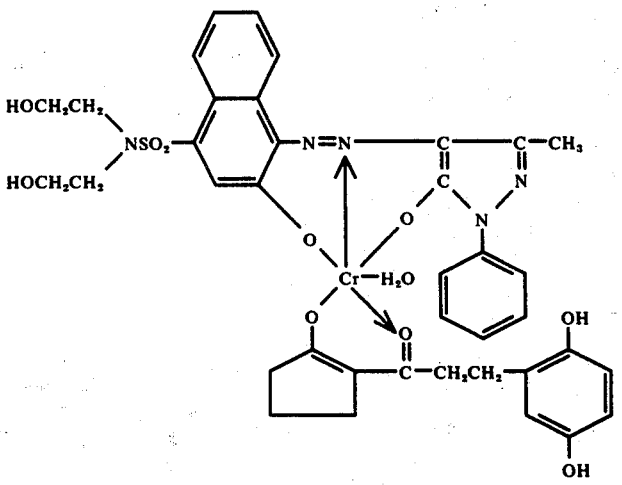

-continued

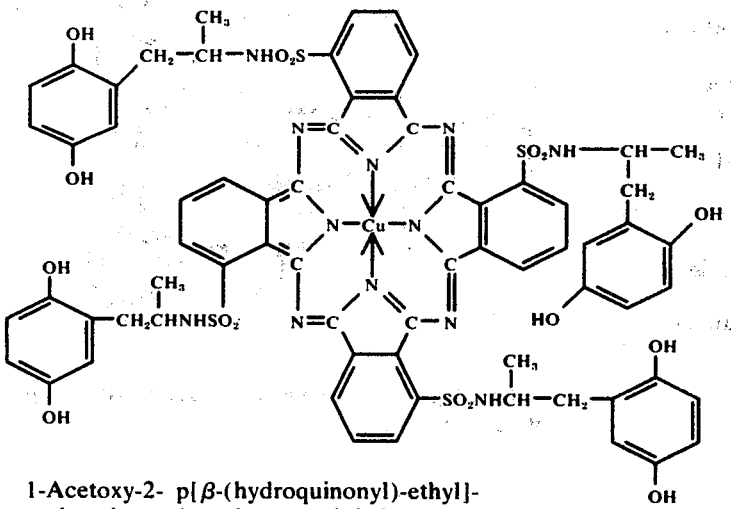

1-Acetoxy-2- p[β-(hydroquinonyl)-ethyl]-phenylazo -4-methoxy-naphthalene
1-Acetoxy-2- p-[β(hyroquinonyl)-ethyl]-phenylazo -4-[(2'-ethoxy)-ethoxy]-naphthalene
1-Acetoxy-2- p-[β-(hydroquinonyl)-ethyl]-phenylazo -4-isopropoxynaphthalene

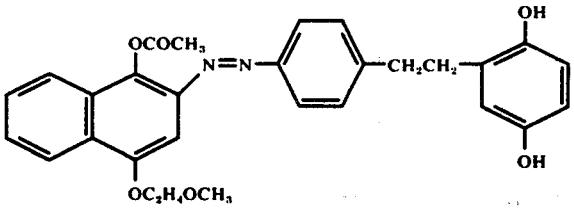

1-Acetoxy-2- p-[β-(hydroquinonyl)-ethyl]-phenylazo -4-(1',4'-dioxapentyl)-naphthalene
α-[p-(2-Hydroquinonylethyl)-phenylazo]-β-(2'-furyl)-β-acetoxy-acrylonitrile
α-[p-(2-Hydroquinonylethyl)-phenylazo]-β-(2'-benzofuranyl)-β-acetoxy-acrylonitrile
α-[m-(2-Hydroquinonylethyl)-phenylazo]-β-(2'-benzofuranyl)-β-acetoxy-acrylonitrile
α-[m-(Hydroquinonylmethyl)-phenylazo]-β-(2'-benzofuranyl)-β-acetoxy-acrylonitrile
α-[p-(2-Hydroquinonylethyl)-phenylazo]-β-[2'-(5'-bromofuryl)]-β-acetoxy-acrylonitrile
α-[p-(2-Hydroquinonylethyl)-phenylazo]-β-[2'-(5'-methoxybenzofuranyl)]-β-acetoxy-acrylonitrile
α-[p-(2-Hydroquinonylethyl)-phenylazo]-β-[2'-(5'-bromobenzofuranyl)]-β-acetoxy-acrylonitrile
α-[p-(2-Hydroquinonylethyl)-phenylazo]-β-[2'-(3'-methyl-benzofuranyl)]-β-acetoxy-acrylonitrile
α-Phenylazo-β-[2-(5'-hydroquinonylacetoamidobenzofuranyl)]-β-acetoxy-acrylonitrile
α-[p-2-Hydroquinonylethyl)-phenylazo]-β-(2'-benzofuranyl)-β-methoxyacetoxy-acrylonitrile

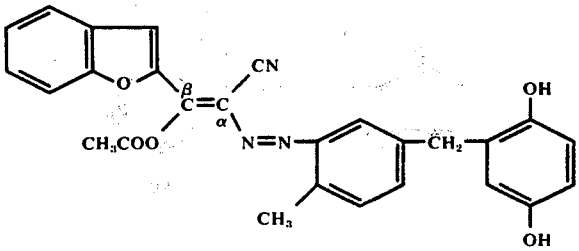

α-[(2-Methyl-5-hydroquinonylmethyl)-phenylazo]-β-(2'-benzofuranyl)-β-acetoxy-acrylonitrile
α-[(2-Acetoxy-5-hydroquinonylmethyl)-phenylazo]-β-(2'-furyl)-β-acetoxy-acrylonitrile
α- [2-Acetoxy-5-(2'-hydroquinonylethyl)]-phenylazo -β-(2'-benzofuranyl)-β-acetoxy-acrylonitrile
α-[(2-Acetoxy-5-hydroquinonylmethyl)-phenylazo]-β-[2'-(5'-bromofuryl)]-β-acetoxy-acrylonitrile
α-[(2-Acetoxy-5-hydroquinonylmethyl)-phenylazo]-β-[2'-(5'-methoxybenzofuranyl)]-β-acetoxy-acrylonitrile
α-[(2-Acetoxy-5-hydroquinonylmethyl)-phenylazo]-β-[2'-(5'-bromobenzofuranyl)]-β-acetoxy-acrylonitrile
α-[(2-Acetoxy-5-hydroquinonylmethyl)-phenylazo]-β-[2'-(3'-methylbenzofuranyl)]-β-acetoxy-acrylonitrile
α-(2-Acetoxyphenylazo)-β-[2'-(5'-hydroquinonylacetoamido-benzofuranyl)]-β-acetoxy-acrylonitrile

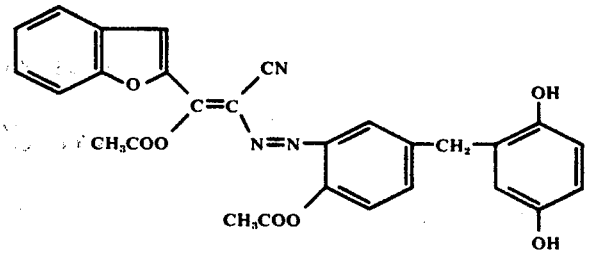

α-[(2-Acetoxy-5-hydroquinonylmethyl)-phenylazo]-β-(2'-benzofuranyl)-β-acetoxy-acrylonitrile
2-[m-(Hydroquinonylmethyl)phenylazo]-3-butyroyloxy-5-methyl-benzothiophene
2-[(2'-Chloro-5-hydroquinonylmethyl)phenylazo]-3-acetoxy-benzothiophene
2-[p-(2'-Hydroquinonylethyl)-phenylazo]-3-acetoxy-benzothiophene 2-[p-(2′-Hydroquinonylethyl)phenylazo]-3-acetoxy-5-chloro-benzothiophene
2-[(2′-Acetoxy-5′-hydroquinonylmethyl)-phenylazo]-3-acetoxybenzothiophene
2-[(2′-Methyl-5′-hydroquinonylmethyl)phenylazo]-3-acetoxy-benzothiophene

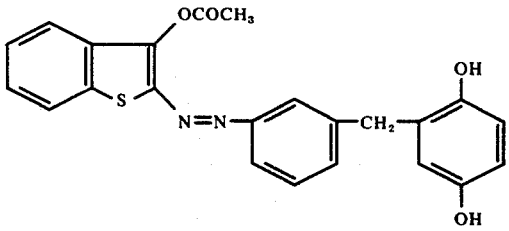

2-[m-(Hydroquinonylmethyl)phenylazo]-3-acetoxy-benzothiophene
1,4-bis(2′,5′-Dihydroxyaniline)-9,10-dihydroxyanthracene
1,5-bis(2′,5′-Dihydroxyaniline)-4,8,9,10-tetrahydroxyanthracene
1,4-bis[β-(2′,5′-Dihydroxyphenyl)-isopropylamino]-9,10-dihydroxyanthracene
1,4-bis[β-(2′,5′-Dihydroxyphenyl)-ethylamino]-9,10-dihydroxyanthracene
1-Chloro-4-[β-(2′,5′-dihydroxyphenyl)-ethylamino]-9,10-dihydroxyanthracene
1,4-bis[γ-(2′,5′-Dihydroxyphenyl)propylamino]-5,8,9,10-tetrahydroxyanthracene
1-[γ-(2′,5′-Dihydroxyphenyl)-propylamino]-4-(βhydroxyethylamino)-5,8,9,10-tetrahydroxyanthracene
1-[(β-Hydroquinonyl-α-methyl)ethylamino]-4-(β-hydroxyethylamino)-5,8,9,10-tetrahydroxyanthracene
1-[β-(2′,5′-Dihydroxyphenyl)ethylamino]-5-(β-hydroxyethylamino)-4,8,9,10-tetrahydroxyanthracene
1,5-bis[(β-Hydroquinonyl-α-methyl)ethylamino]-4,8,9,10-tetrahydroxyanthracene
1-[β-(2′,5′-Dihydroxyphenyl)ethylamino]-4-hexylamino-5,8,9,10-tetrahydroxyanthracene
1,4-bis[(β-Hydroquinonyl-α-ethyl)ethylamino]-5,8,9,10-tetrahydroxyanthracene
1,4-bis[(β-Hydroquinonyl-α-methyl)ethylamino]-5,8,9,10-tetrahydroxyanthracene
1,4-bis[(β-Hydroquinonyl-α-ethyl)ethylamino]-9,10-dihydroxyanthracene
1,4-bis[(β-Hydroquinonyl-α-methyl)-ethylamino]-5,9,10-trihydroxyanthracene
1-(β-Hydroxy-α-ethyl-ethylamino)-4-(β-hydroquinonyl-α-methyl-ethylamino)-9,10-dihydroxyanthracene
1-(Butanol-2′-amino)-4-(β-hydroquinonyl-isopropylamino)-5,8,9,10-tetrahydroxyanthracene
1,8-bis[(β-Hydroquinonyl-α-methyl)ethylamino]-4,5,9,10-tetrahydroxyanthracene
N-Monobenzoly-1,4-bis[β-(3′,4′-dihydroxyphenyl-)ethylamino]-9,10-dihydroxyanthracene
N-Monobenzoly-1,4-bis[β-(2′,5′-dihydroxyphenyl-)ethylamino]-9,10-dihydroxyanthracene
1,4-Diamino-2-[ε-(α-methyl-2′,5′-dihydroxyhydrocinnamido)-pentoxy]-9,10-dihydroxyanthracene
1,4-Diamino-2-[ε-(α-ethyl-2′,5′-dihydroxyhydrocinnamido)-pentoxy]-9,10-dihydroxyanthracene
1,4-Diamino-2-[ε-(2′,5′-dihydroxyhydrocinnamido)-pentoxy]-9,10-dihydroxyanthracene

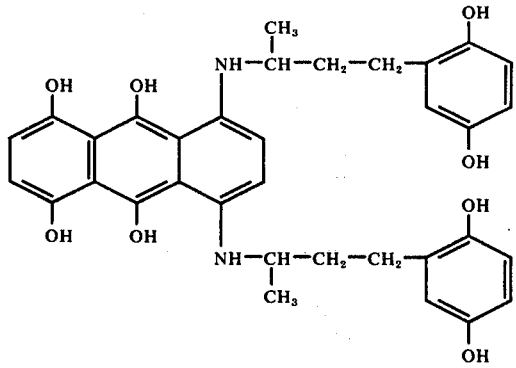

1,4-bis[(γ-Hydroquinony)-α-methyl)-propylamino]-5,8,9,10-tetrahydroxyanthracene
1-(o-Carboxyphenyl)-3-phenyl-4-[p-(2′,5′-ditrifluoroacetoxy-β-phenylethyl)phenylazo]-5-hydroxypyrazole lactone

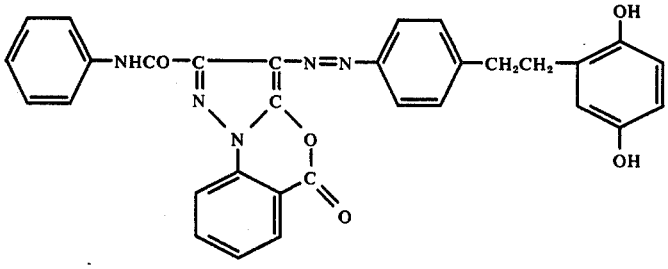

1-(o-Carboxyphenyl)-3-N-phenylcarbamoyl-4-[p-(β-hydroquinonylethyl)phenylazo]-5-hydroxypyrazole lactone
α- [2-Butyroyloxy-5-(2′,5′-butyroyloxy-phenylmethyl)]-phenylazo -β-(2″-benzofuranyl)-β-butyroyloxyacrylonitrile
2-[m-(2′,5′-Butyroyloxy-phenylmethyl)phenylazo]-3-butyroyloxybenzothiophene
α-[p-(2,5-Butyroyloxy-β-phenylethyl)phenylazo]-β-(2′-benzofuranyl)-β-butyroyloxy-acetonitrile

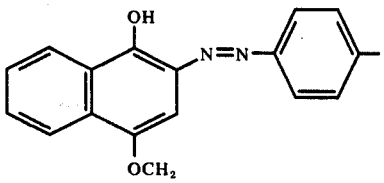

-continued

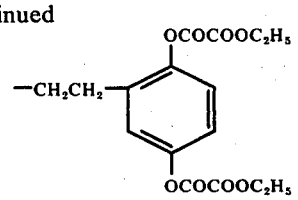

2-[p-(2′,5′-Ethoxyoxaloxyphenethyl)phenylazo]-4-methoxy-1-naphthol

Developing agents such as 1-phenyl-3-pyrazolidone described in U.S. Pat. No. 3,039,869, hydroquinone derivatives such as 4′-methylphenylhydroquinone, t-butylhydroquinone, etc., or catechol derivatives such as 4-methoxycatechol described in U.S. Pat. No. 3,617,277 can be used as the auxiliary developing agent used in the present invention.

Further hydroquinone and derivatives thereof having a sufficient solubility in water can be used in addition to these auxiliary developing agents. Examples of such compounds which can be used include, for example, hydroquinone, hydroxyhydroquinone, chlorohydroquinone, methylhydroquinone, methoxyhydroquinone, hydroxymethylhydroquinone, aminohydroquinone hydrochloride, 2,5-diaminohydroquinone hydrochloride, aminomethylhydroquinone hydrochloride, aminoethylhydroquinone hydrobromide, 2,5-dihydroxythiophenol, etc.

Furthermore, another type of auxiliary developing agents, such as quinone or derivatives thereof can also be used. For example, benzoquinone, phenylbenzoquinone, 4′-methylphenylbenzoquinone, 2,3,5-trimethylbenzoquinone, naphthoquinone-1,4,2,5-dimethoxybenzoquinone, 2,6-dimethylbenzoquinone, bromobenzoquinone, 2,5-dichlorobenzoquinone, cyclohexylbenzoquinone, 2,5-di-n-butylbenzoquinone, p-chlorobenzoquinone, touquinone, 2,5-diphenylbenzoquinone, dodecylbenzoquinone, 2,6-diiodobenzoquinone, fluorobenzoquinone, 2,5-diarylbenzoquinone, 2-chlorophenylbenzoquinone, 3′-nitrophenylbenzoquinone, benzylbenzoquinone, etc., can be used.

Still further, amyl gallate described in Japanese Patent Application No. 124,916/72 and the spiro compounds described in Japanese Patent Application Nos. 82,274/72 and 125,611/72 can be used.

The above-described auxiliary developing agents can be used individually or as a combination of two or more thereof.

The dye image-providing material used in the present invention can be dispersed in a carrier, a hydrophilic colloid, according to various methods depending upon the type of the dye image-providing material. For example, compounds having a dissociative group such as a sulfo group or a carboxy group such as diffusible dye-releasing couplers can be added to a hydrophilic colloid solution after being dissolved in water or in an alkaline aqueous solution. With dye image-providing materials which are slightly soluble in an aqueous medium and readily soluble in an organic solvent, they are first dissolved in an organic solvent, and then the resulting solution is added to a hydrophilic colloid solution, followed by stirring or the like to disperse the solution as fine particles. Suitable solvents which can be used are ethyl acetate, tetrahydrofuran, methyl ethyl ketone, cyclohexanone, β-butoxy-β-ethoxyethyl acetate, dimethylformamide, dimethylsulfoxide, 2-methoxyethanol, tri-n-butylphthalate, etc. Of these dispersion solvents, those solvents which possess comparatively high vapor pressures can be vaporized upon drying of the photographic layers, or can be vaporized according to the method described in U.S. Pat. Nos. 2,322,027 and 2,801,171 prior to coating. Of these dispersion solvents, those solvents which are readily soluble in water can be removed by washing with water according to U.S. Pat. Nos. 2,949,360 and 3,396,027.

In order to stabilize the dispersion of the dye image-providing material and accelerate the dye image-forming step, it is advantageous to incorporate, in a light-sensitive element, a solvent which is substantially insoluble in water and has a boiling point of not less than about 200° C under ordinary pressure together with the dye image-providing material. High boiling solvents suitable for this purpose include fatty acid esters such as triglycerides of higher fatty acids and dioctyl adipate; phthalic esters such as di-n-butyl phthalate; phosphoric esters such as tri-o-cresyl phosphate and tri-n-hexyl phosphate; amides such as N,N-diethyllaurylamide; hydroxy compounds such as 2,4-di-namylphenol; and the like. Furthermore, in order to stabilize the dispersion of dye image-providing material and to accelerate the step of dye image formation, it is advantageous to incorporate in a light-sensitive element a polymer having affinity for the solvent together with the dye image-providing material. Polymers having affinity for the solvent and suitable for this purpose include shellac, phenol-formaldehyde condensates, poly-n-butyl acrylate, n-butyl acrylate-acrylic acid copolymers, ethylene glycol-propylene glycol-adipic acid polyesters; ethylene glycol-propylene glycol-adipic acid copolymers; n-butyl acrylate-styrene-methacrylamide copolymers, and the like. These polymers can be dissolved in an organic solution together with the dye image-providing material and then dispersed in a hydrophilic colloid, or can be added, as a hydrosol prepared by emulsion polymerization or the like, to a hydrophilic colloid dispersion of the dye image-providing material.

In general, the dispersion of the dye image-providing material can be effectively conducted under great shearing force. For example, a high speed rotary mixer, a colloid mill, a high pressure milk homogenizer, a high pressure homogenizer as described in British Pat. No. 1,304,264, an ultrasonic emulsifying apparatus, and the like are useful. The use of a surface active agent as an emulsifying aid markedly helps to disperse the dye image-providing material. Surface active agents useful for the dispersion of the dye image-providing material used in the present invention include sodium triisopropylnaphthalenesulfonate, sodium dinonylnaphthalenesulfonate, sodium p-dodecylbenzenesulfonate, dioctyl sulfosuccinate sodium salt, sodium cetylsulfate and the anionic surface active agents described in Japanese Patent Publication No. 4,239/64. The combined use of these anionic surface active agents and higher fatty acid esters of anhydrohexitol exhibits a particularly good emulsifying ability as described in U.S. Pat. No. 3,676,141.

The silver halide emulsion used in the present invention is a colloidal dispersion of a silver halide such as silver chloride, silver bromide, silver chlorobromide, silver bromoiodide, silver chlorobromoiodide or a mixture thereof. The halide composition is selected depending upon the end-sue purposes of the light-sensitive material and the processing conditions. In particular, a silver bromoiodide emulsion or silver chlorobromoiodide emulsion containing about 1 mol% to about 10 mol% iodide, not more than about 30 mol% chloride and the balance bromide is desirable. Useful silver halide grains have a mean grain size of about 0.1 $\mu$ to about 2 $\mu$. For some end-use purposes of the light-sensitive material, silver halides having a uniform grain size are desirable. The grains can be in a cubic form, an octahedral form or in a mixed crystal form. These silver halide emulsions can be prepared according to known conventional processes, e.g., as described in P. G. Glafkides; *Chimie Photographique* 2nd Ed., Chapters 18 to 23, Paul Montel, Paris (1957). That is, a water-soluble silver salt such as silver nitrate and a water-soluble halide such as potassium bromide are reacted with each other in the presence of a solution of a protective colloid such as gelatin and crystals are allowed to develop in the presence of excess halide or a silver halide solvent such as ammonia. In this occasion, a single or double jet method or a pAg-controlled double jet method can be empolyed as the precipitating method. Removal of the soluble salts from the emulsion can be effected by washing and dialysis of the cool-set emulsion, by a combination of the addition of a sedimenting agent such as an anionic polymer containing sulfone groups, sulfuric ester groups or carboxy groups or an anionic surface active agent and the adjustment of the pH, or by a combination of the use of an acylated protein such as phthaloyl gelatin as a protective colloid and the adjustment of the pH, to thereby cause sedimentation.

The silver halide emulsions which are used in the present invention are preferably subjected to a chemical sensitization by a heat-treatment using the natural sensitizers contained in gelatin, a sulfur sensitizer such as sodium thiosulfate or N,N,N'-trimethylthiourea, a gold sensitizer such as a thiocyanate complex salt or thiosulfate complex salt of monovalent gold, or a reducing sensitizer such as stannous chloride or hexamethylenetetramine. Also emulsions which tend to form a latent image on the surface of the silver halide grains and emulsions which tend to form a latent image inside the silver halide grains as described in U.S. Pat. Nos. 2,592,550, 3,206,313, etc. can be used in the present invention.

The silver halide emulsions which can be used in the present invention can be stabilized by incorporation therein of additives such as 4-hydroxy-6-methyl-1,3,3*a*,7-tetrazaindene, 5-nitroimidazole, 1-phenyl-5-mercaptotetrazole, 8-chloromercuriquinoline, 2-mercapto-5-sulfobenzimidazole, benzenesulfinic acid, pyrocatechin, 4-methyl-3-sulfoethylthiazolidine, 4-phenyl-3-sulfoethylthiazolidine-2-thione, etc. In addition, in organic compounds such as cadmium salts, mercury salts, complex salts of platinum group metals such as the chloro complex salt of palladium, and the like are also useful for stabilizing the light-sensitive material of the present invention. Furthermore, the silver halide emulsions to be used in the present invention can contain sensitizing compounds such as a polyethylene oxide compound.

The silver halide emulsions used in the present invention can possess, if desired, a color sensitivity expanded with optical sensitizing dyes. Useful optical sensitizing agents include cyanines, merocyanines, holopolar cyanines, styryls, hemicyanines, oxanols, hemioxanols, and the like. Specific examples of optical sensitizing agents are described in P.G. Glafkides, supra, Chapters 35 to 41, and F.M. Hamer; *The Cyanine Dyes and Related Compounds* (Interscience). In particular, cyanine compounds in which a nuclear nitrogen atom is substituted with an aliphatic group having a hydroxy group, a carboxy group or a sulfo group, e.g., those described in U.S. Pat. No. 2,503,776, 3,459,553, and 3,177,210, are especially useful for the practice of the present invention.

The processing solution permeable layers to be used in the invention such as the silver halide emulsion layer, the dye image-providing material-containing layer and the auxiliary layers (e.g., a protective layer, an interlayer, etc.) contain a hydrophilic polymer as a binder. Suitable hydrophiic polymers are gelatin, casein, gelatin modified with an acylating agent or the like, vinyl polymer-grafted gelatin, proteins such as albumin, cellulose derivatives such as hydroxyethyl cellulose, methyl cellulose, carboxymethyl cellulose, etc., polyvinyl alcohol, partially hydrolyzed products of polyvinyl acetate, polyvinyl pyrrolidone, high molecular weight non-electrolytes such as polyacrylamide, polyacrylic acid, partially hydrolyzed products of polyacrylamide, anionic synthetic polymers such as vinyl methyl ether-maleic acid copolymers, N-vinylimidazoleacrylic acid-acrylamide copolymers, synthetic polymer amphoteric electrolytes such as polyacrylamide have been subjected to the Hoffman reaction. These hydrophilic polymers can be used individually or in combination. Publication these hydrophilic polymer layers can contain a latex-like polymer dispersion of hydrophobic monomers such as alkyl acrylates, alkyl methacrylates, etc. These hydrophilic polymers, particularly, polymers having functional groups such as amino groups, hydroxy groups or carboxy groups can be rendered insoluble with various cross-linking agents without loss of processing solution permeability. Particularly useful cross linking agents include aldehyde compounds such as formaldehyde, glyoxal, glutaraldehyde, mucochloric acid, acrolein oligomer, etc.; aziridine compounds such as triethylenephosphoramide described in Japanese Pat. Publication No. 8,790/62; epoxy compounds such as 1,4-bis(2',3'-epoxypropoxy)diethyl ether described in Japanese Pat. Publicaton No. 7,133/59; active halogen compounds such as 2-hydroxy-4,6-dichloro-s-triazine sodium salt; active olefin compounds such as hexahydro-1,3,5-triacryl-s-triazine; methylol compounds such as N-polymethylol urea, hexamethylol melamine, etc.; high molecular weight compounds such as dialdehyde starch or 3-hydroxy-5-chloro-s-triazinyl gelatin, described in U.S. Pat. No. 3,362,827, etc. These hydrophilic polymers can contain a cross linking-accelerating agent such as a carbonate or resorcin as well as the cross linking agent.

The photographic layers used in the present invention can be coated using various methods such as a dip coating method, a roller coating method, an air knife coating method, a bead coating method described in U.S. Pat. No. 2,681,294, a curtain coating method described in U.S. Pat. Nos. 3,508,947, and 3,513,017, etc. In particular, with light-sensitive elements of a multi-layered structure, it is convenient to coat a number of layers at the same time using a multislit hopper described in U.S. Pat. Nos. 2,761,417, 2,761,418, 2,761,419 and 2,761,791. A suitable amount of silver halide in each emulsion layer coated ranges from about 0.001 to 0.2 mol/m$^2$ of the support.

In order to facilitate the coating of the photographic layers used in the present invention, the coating compositions advantageously contain various surface active agent as a coating aid. Useful coating aids include nonionic surface active agents such as saponin, p-nonylphenol ethylene oxide adducts, alkyl ethers of sucrose, glycerin monoalkyl ethers, etc., anionic surface active agents such as sodium dodecylsulfate, sodium p-dodecylbenzenesulfonate, dioctylsulfosuccinate sodium salt, etc., and amphoteric surface active agents such as carboxymethyldimethyllaurylammonium hydroxide inner salt, "Deriphat 151" trade name of the General Mills Co., betaine compounds described in U.S. Pat. No. 3,441,413, British Pat. No. 1,159,825 and Japanese Pat. Publication No. 21,985/71, etc.

In order to facilitate the coating of the photographic layers used in the present invention, the coating composition can contain various thickening agents. For example, in addition to those agents which increase the viscosity of the coating composition due to their own viscosity such as high molecular weight polyacrylamide, anionic polymers such as cellulose sulfate, poly-p-sulfostyrene potassium salt and acrylic polymers described in U.S. Pat. No. 3,655,407 which exhibit a thickening action due to a mutual interaction with a binder polymer contained in the coating composition are similarly useful.

The processing composition used in the present invention is a liquid composition containing the processing components necessary for the development of the silver halide emulsion and necessary for the formation of diffusion transferred dye image. The main solvent therein is water and, in some cases, a hydrophilic solvent such as methanol or methyl Cellosolve can be additionally present. The processing composition contains alkali in an amount sufficient to maintain the pH at a level necessary to cause the development of the emulsion layer and to neutralize the acids produced during the various steps of development and dye image formation. Examples of alkalis which can be used include sodium hydroxide, potassium hydroxide, calcium hydroxide dispersion, tetramethylammonium hydroxide, sodium carbonate, trisodium phosphate, diethylamine, etc. The processing composition preferably has a pH of not less than about 12 at room temperature (e.g., about 20°–30° C). More preferably, the processing composition contains a hydrophilic polymer such as a high molecular weight polyvinyl alcohol, hydroxyethyl cellulose, sodium carboxymethyl cellulose or the like. These polymers impart to the processing composition a viscosity of not less than about 1 poise, preferably about 1,000 poise, at room temperature, which not only facilitates the uniform spreading of the processing composition on processing but also the formation of an immovable film, upon concentration of the processing compositions due to the migration of the aqueous solvent into the light-sensitive element and the image-receiving element during the course of the processing, thus serving to unify the film unit after processing. In addition, this polymer film can serve, after the substantial completion of the formation of the diffusion transferred dye image, to control a further migration of the coloring components into the image-receiving layer, thereby preventing the image from being changed.

In some cases, the processing composition advantageously contains a light absorbent such as carbon black and a desensitizer described in U.S. Pat. No. 3,579,333 to prevent the silver halide emulsion from being fogged by ambient light during processing, e.g., outside a camera. Furthermore, the processing composition advantageously contains processing ingredients specific to the dye image-providing material used. When dye developers are used as the dye image-providing material, auxiliary developing agents such as p-aminophenol, 4'-methylphenylhydroquinone, 1-phenyl-3-pyrazolidone, etc., an onium development accelerater such as N-benzyl-α-picolinium bromide, an antifogging agent such as benzotriazole are the examples of such components and, when diffusible dye-releasing couplers are used as a dye image-providing material, developing agents such as an aromatic primary amino color developing agent, an antioxidizing agent such as a sulfite or ascorbic acid, an antifogging agent such as a halide or 5-nitro-benzimidazole, a silver halide solvent such as thiosulfate or uracil are examples of such components.

The processing composition used in the present invention is advantageously retained in a pressure rupturable container. Such a container is advantageously prepared by folding a sheet of a liquid and air-impervious material and sealing each edge to form a cavity in which the processing composition is to be retained, and the container is advantageously constituted so that, when the unit is passed through pressure-applying members, the container is ruptured at a given point due to the inner hydraulic pressure generated within the processing composition to thereby release the contents. A polyethylene terephthalate/polyvinyl alcohol/polyethylene laminate, a lead foil/vinylchloride-vinyl acetate copolymer laminate or the like can be advantageously used as the material for forming the container. This container is desirably fixedly positioned and extends transverse a leading edge of the film unit (i.e., in the direction of travel of the film unit with respect to the pressure applying means) to effect a substantially uni-directional discharge of the contents of the container on the surface of the light-sensitive element. Preferred examples of such containers are described in U.S. Pat. Nos. 2,543,188, 2,643,886, 2,653,732, 2,723,051, 3,056,491, 3,056,492, and 3,152,515. These containers are advantageous for the practice of the present invention.

The image-receiving element used in the invention fixes the dye image-forming materials such as the diffusible dyes, etc. which are released in an imagewise distribution from the dye image-providing materials associated with the silver halide emulsion. Where dye developers having a hydroquinonyl group or anionic material such as color dyes having an acidic water-solubilizing group are used as the dye image-forming material, the image-receiving element preferably contains a basic polymer or a basic surface active agent. As basic polymers those which contain tertiary or quaternary nitrogen atoms are excellent. More specifically, illustrative examples include poly-4-vinyl-pyridine, a polymer of the aminoguanidine derivative of vinyl methyl ketone described in U.S. Pat. No. 2,882,156, poly-4-vinyl-N-benzylpyridinium p-toluenesulfonate, poly-3-vinyl-4-methyl-N-n-butylpyridinium bromide, styrene/N-(3-maleimidopropyl)-N,N-dimethyl-N-4-phenylbenzylammonium chloride copolymer described in British Pat. No. 1,261,925, poly[N-(2-methacryloylethyl)-N,N-dimethyl-N-benzylammonium]chloride, etc. As basic surface active agents, those which possess an onium residue such as an ammonium, sulfonium or phosphonium residue and possess a hydrophobic residue such as a long-chain alkyl group are excellent. More specifically, examples include N-laurylpyridinium bromide, cetyltrimethylammonium bromide, methyl-tri-n-laurylammonium p-toluenesulfonate, methyl-ethyl-cetylsulfonium iodide, benzyltriphenylphosphonium chloride, etc. In addition to these basic compounds, multivalent metals such as thorium, aluminum, zirconium, etc. also exert a fixing action on anionic dye-forming materials. These substances advantageously form films together with polymers such as gelatin (in particular acid-processed gelatin), polyvinyl alcohol, polyacrylamide, polyvinyl methyl ether, hydroxyethyl cellulose, N-methoxymethylpolyhexylmethyleneadipamide, polyvinylpyrrolidone, etc.

Where the dye image-forming material is one component for forming a dye like a diffusible coupler, the image-receiving layer contains another coupling component capable of reacting with this component to form a dye, such as a p-phenylenediamine derivative and an oxidizing agent, or a diazonium compound. This type of image-receiving element is described in U.S. Pat. Nos. 2,647,049, 2,661,293, 2,698,244, 2,698,798, 2,802,735, 3,676,124, British Pat. Nos. 1,158,440, 1,157,507, etc. The image-receiving layer, suitably, has a thickness of about 2 $\mu$ to 30 $\mu$.

The diffusion transfer photographic film unit of the present invention preferably possesses the function of neutralizing the alkali brought thereinto from the processing composition. The processing composition contains alkali so as to provide a pH of higher than about 10, preferably higher than 11, which is sufficiently high to accelerate the image-forming steps comprising the development of the silver halide emulsion and the formation and diffusion of the diffusible dye image-forming material. After the substantial completion of the formation of the diffusion transferred images, the pH in the film unit is reduced to around neutrality, i.e., less than about 9, preferably less than 8, whereby further image-formation is actually discontinued to prevent the image tone from being changed with the lapse of time and to control discoloration and fading of the images and stain of the white background due to high alkalinity. For this purpose, it is advantageous to provide in the film unit a neutralizing layer containing an acidic substance in a sufficient quantity to neutralize the alkali contained in the processing composition to the above-described pH, that is, in an area concentration equivalent to or more than the amount of the alkali contained in the spread processng conposition. Preferred acidic substances are those which contain an acidic group having a pKa of less than about 9, particularly a carboxy group or a sulfonic acid group, or contain a precursor group capable of providing such an acidic group upon hydrolysis. More preferred examples are higher fatty acids such as oleic acid described in U.S. Pat. 2,983,606, polymers of acrylic acid, methacrylic acid or maleic acid, the partially esterified polymers of maleic acid, or of maleic acid anhydrides. Specific examples of high molecular weight acidic materials are, copolymers of a vinyl monomer (e.g., ethylene, vinyl acetate, vinyl methyl ether, etc.) and maleic anhydride, and the n-butyl half ester thereof; copolymers of butyl acrylate and acrylic acid; cellulose acetate hydrogen phthalate; and the like. In addition to these acidic materials the neutralizing layer can contain polymers such as cellulose nitrate and polyvinyl acetate, and a plasticizer as described in U.S. Pat. No. 3,557,237. Furthermore, the neutralizing layer can be hardened through a cross linking reaction with a multifunctional aziridine compound, epoxy compound, etc. The neutralizing layer can be positioned in the image-receiving element and/or the light-sensitive element. In particular, the neutralizing layer is advantageously positioned between the support of the image-receiving element and the imagereceiving layer. As described in German Patent Application OLS 2,038,254, the acidic substances can be microencapsulated for incorporation in the film unit.

The neutralizing layer or the acidic substance-containing layer, whose thickness, in general, ranges about 5 $\mu$ to 50 $\mu$, used in the present invention is desirably separated from the spread processing composition layer by a neutralization ratecontrolling (or timing) layer. This timing layer functions to prevent an undesirable reduction in the transfer image density due to a too fast reduction in the pH before the necessary development of the silver halide emulsion layer and the formation of the diffusion transfer image are completed. That is, the timing layer functions to delay the reduction in pH until necessary development and transfer are completed. In a preferred embodiment of the present invention, the image-receiving element possesses a multilayered structure comprising a support—a neutralizing layer —a timing layer—a mordant layer (image-receiving layer) in this sequence. The timing layer comprises mainly polymers such as gelatin, polyvinyl alcohol, polyvinyl propyl ether, polyacrylamide, hydroxypropylmethyl cellulose, isopropyl cellulose, partially butyrated polyvinyl alcohol, partially hydrolyzed polyvinyl acetate, copolymers of $\beta$-hydroxyethyl methacrylate and ethyl acrylate, and the like. These polymers can be advantageously hardened through a cross linking reaction with an aldeyde compound such as formaldehyde or an N-methylol compound. The timing layer preferably has a thickness of about 2 $\mu$ to 20 $\mu$.

In the light-sensitive element used in the present invention, a dye image-providing material is associated with a silver halide emulsion. The combination of the color sensitivity of the silver halide emulsion and the spectral absorption of the dye image is appropriately selected depending upon the intended color reproduction. In the reproduction of natural colors according to subtractive color photography, a light-sensitive element having at least two combinations of silver halide emulsions, each having a selective spectral sensitivity in a certain wavelength region with compounds capable of providing images having selective spectral absorption in the same wavelength region, is used. In particular, a light-sensitive element having a combination of a blue-sensitive silver halide emulsion with a compound capable of providing a yellow dye image, the combination of a green-sensitive silver halide emulsion with a compound capable of providing a magenta dye image, and the combination of a red-sensitive silver halide emulsion with a compound capable of providing a cyan dye image is useful. In the light-sensitive element, these combination units of silver halide emulsions and dye image-providing materials are coated as layers in a face-to-face alignment or coated by forming each into particles and mixing the particles. In a preferred multilayered structure, a blue-sensitive silver halide emulsion, a green-sensitive silver halide emulsion and a redsensitive silver halide emulsion are positioned in sequence on a support from the side to be exposed to incident light. In particular, in the case of high speed emulsions containing silver iodide, a yellow filter layer can be positioned between the bluesensitive silver halide emulsion and the green-sensitive silver halide emulsion. This yellow filter layer can contain a yellow colloidal silver dispersion, an oil-soluble yellow dye dispersion, an acidic dye mordanted with a basic polymer, or a basic dye mordanted with an acidic polymer. The emulsion layers are advantageously separated from each other by an interlayer. The interlayer prevents unfavorable mutual inter-actions from occurring between emulsion layer units having different color sensitivities. The interlayer can comprise a polymer containing fine pores formed by a latex of a hydrophilic polymer and a hydrophobic polymer, described in U.S. Pat. No. 3,625,685, or a polymer whose hydrophilicity is gradually increased by the processing composition, such as calcium alginate, described U.S. Pat. No. 3,384,483, as well as a hydrophilic polymer such as gelatin, polyacrylamide, partially hydrolyzed products of polyvinyl acetate, etc. The interlayer can contain an interlayer mutual interaction-controlling agent selected depending upon the type of the dye image-providing material and the processing composition used. For example, with a dye image-providing material of the type which releases a diffusible dye due to the action of the oxidation product of a developing agent, reducing agents such as ballasted hydroquinone derivatives and ballasted couplers capable of reacting with the oxidation product to fix it are effective for preventing a disadvantageous interchange of the oxidation product of a developing agent between emulsion layer units. Furthermore, in order to attain good color reproduction, it is useful, in a system wherein image reversion is effected by a dissolution-physical development process, to further incorporate in the interlayer physical development nuclei such as a metallic silver colloid and, in a system wherein image reversion is effected using a development inhibitor-releasing (DIR) compound, it is useful to incorporate silver halide grains having a low sensitivity and a fine size in the interlayer.

The support which can be used in the present invention is a substantially planar material which does not undergo any serious dimensional change due to contract with the processing composition during processing. For some purposes, rigid supports such as a glass plate can be used. However, in general, flexible supports are useful. Suitable flexible supports which can be advantageously used are those generally used for photographic light-sensitive materials, such as a cellulose nitrate film, a cellulose acetate film, a polyvinylacetal film, a polystyrene film, a polyethylene terephthalate film, a polycarbonate film, etc. Supports having dimensional stability and oxygen impermeability such as a laminate in which a polyvinyl alcohol layer is sandwiched between polyethylene terephthalate layers or between cellulose acetate layers is particularly desirable since it serves to provide stable images and less stains occur. In order to help moisture contained in the spread processing composition evaporate through the support after processing, it is advantageous to use an aqueous vapor permeable support such as is described in U.S. Pat. No. 3,573,044. In order to prevent incident light leakage through the edge of the transparent support to the silver halide emulsion layer during processing of film unit in a bright place, the transparent support is desirably colored to an extent such that the transmission of light in a plane direction to the support can be prevented without inhibiting imagewise exposure and observation therethrough. If desired, the support can contain a plasticizing agent such as a phosphoric ester, a phthalic ester, etc., an ultraviolet-absorbing agent such as2-(2-hydroxy-4-t-butylphenyl)benzotriazole, etc., an antioxidant such as a hindered phenol, etc. In order to achieve good adhesion between the support and the hydrophilic polymer-containing layer, it is advantageous to provide a subbing layer or to subject the surface of the support to a preliminary treatment such as a corona discharge, an irradiation with ultraviolet light or a flame treatment. The support usually has a thickness of about 20 to 300 $\mu$.

In one preferred embodiment of the present invention, the image-receiving layer is positioned between the transparent support and the processing composition-permeable light-reflecting layer. With this film unit, dye images formed by the photographic processing can be viewed through the transparent support, and hence it is not necessary to separate the light-sensitive element from the image-receiving element after image transfer. Specific examples of film units having such a structure are described in U.S. Pat. Nos. 2,983,606, 3,415,644, 3,415,645, 3,415,646, 3,594,164, and 3,594,165, etc.

In one non-delamination type film unit, a silver halide emulsion associated with a dye image-providing material is coated on a support which does not transmit light. This film unit is imagewise exposed from the opposite side to the support. After exposure, a processing composition is spread between the surface of the silver halide emulsion layer and the image-receiving layer provided on a transparent support. The processing composition contains a light-reflecting material, and the dye images formed by diffusion through the processing solution layer to the image-receiving layer are viewed through the transparent support. With this film unit, it is necessary to use a camera having a special optical inversion system, e.g., a mirror, etc. in order to obtain non-inverted normal images.

In another non-delamination type film unit, a silver halide emulsion associated with a dye image-providing material is coated on a transparent support. This film unit is imagewise exposed through the support. After imagewise exposure, a processing composition is spread between the surface of the silver halide emulsion layer and the image-receiving layer on the transparent support. Dye images diffused through the processing solution and fixed in the image-receiving layer are then viewed through the transparent support with the light-reflecting material for a background, the light-reflecting substance having previously been spread as a layer between the silver halide emulsion layer and the image-receiving layer or having been present in the processing composition and spread as a layer.

In a further non-delamination type film unit, the material comprises a transparent support having coated thereon, in sequence, an image-receiving layer, a light-reflecting layer, a light absorbent-containing light-intercepting layer and a silver halide emulsion layer associated with a dye image-providing material.

This material is imagewise exposed from the opposite side to the support. Then, a processing composition is spread on the surface of silver halide emulsion. Dye images diffused through the light-intercepting layer and the light-reflecting layer and fixed in the image-receiving layer are viewed through the transparent support. Film units wherein the surface of the silver halide emulsion layer is covered by a transparent cover sheet and which are designed so that the unit is exposed through this cover sheet and so that a light absorbent-containing processing composition is spread between the cover sheet and the surface of the emulsion layer are particularly useful.

In the present invention, a light-reflecting material is used in order to form a white background of the dye image formed in the image-receiving layer. Suitable light-reflecting materials are titanium dioxide, barium sulfate, zinc oxide, alumina, barium stearate, calcium carbonate, silicate, zirconium oxide, kaolin, magnesium oxide, etc. These materials can be used individually or in combination. Such a light-reflecting material can be either initially formed or, as is described in Belgian Pat. Nos. 768,110 and 768,111, formed in a given position from a precursor distributed in a film unit. The light-reflecting material can be incorporated in the layer which contains a hydrophilic polymer such as polyvinylacohol. gelatin, hydroxypropyl cellulose, polyvinyl pyrrolidone, etc. as a binder. Furthermore, the light-reflecting material can be compounded in the processing composition so that, upon spreading of the processing composition, the light-reflecting material is fixed in a dispersed state in a layer of a film-forming polymer such as hydroxyethyl cellulose or carboxymethyl cellulose formed upon spreading. The combined use of the light-reflecting material and a fluorescent brightening agent such as stilbene, coumarin, triazine, oxazole, etc. provides a beautiful white background. In order to protect the silver halide emulsion layer from ambient light during processing, it is advantageous to incorporate, a dye which is colored at a pH higher than the pKa of the dye and becomes colorless at a pH less than the pKa of the dye as is described in Belgian Pat. Nos. 743,336, 768,107 and 768,109. The light-reflecting material-containing layer advantageously possesses a light-reflecting material/binder polymer composition ratio (by weight) of about 0.5:1 to about 100:1, and generally has a dry thickness of about 5 $\mu$ to 50 $\mu$. Also, this layer possesses a reflectivity of not less than about 50%, preferably not less than 70%.

As described above, the film unit of the present invention has a rupturable container retaining the processing composition. When pressed by pressure-applying members, this container is ruptured due to the internal pressure to release the processing composition in a predetermined manner. A variety of pressure-applying members can be used. In particular, a pressure applying means which comprises at least one pair of members juxtaposed with a certain gap or clearance is suited for the processing of the film unit of the present invention. A pair of members are fixedly positioned with a certain clearance or oppose each other through a spring or like elastic body. The members may be rod-shaped freely rotating rollers or motor-driven rollers. Upon passage between a pair of juxtaposed pressure-applying members, the container is ruptured and the processing composition is released and spread between the two elements in a layer form. Those juxtaposed pressure-applying members as described in U.S. Pat. Nos. 3,647,441 and 3,652,281 can be advantageously used.

In the film unit of the present invention, development processing can be continued outside a camera in a bright place. The silver halide emulsion layer is protected from ambient light until development and transfer of the dye images are substantially completed. For this purpose, it is advantageous to dispose a light absorbent-containing light-intercepting layer on the side of the silver halide emulsion layer. The light-intercepting layer is rendered processing composition-permeable (hydrophilic) or processing composition-impermeable (dimensionally stable) depending upon the position of the light-intercepting layer. A processing composition-permeable, light-intercepting layer is a water-permeable polymer layer such as a gelatin, polyvinyl alcohol, polyacrylamide, polyhydroxyethyl cellulose, sodium carboxymethyl cellulose, methyl cellulose, etc. layer containing a light-intercepting material. The layer can be coated as a complete layer or can be spread, upon processing, as a processing solution layer.

The dimensionally stable light-intercepting layer can be a light absorbent-containing polymer layer as described in Japanese Patent Publication No. 24,547/68 and U.S. Pat. No. 3,607,818, and can be contained in the film unit as a support or a light-intercepting element. The dimensionally stable, light-intercepting layer can also be prepared from a foil of a metal such as aluminum or tin, a laminated film of a metal foil and a polymer, an aluminum-vacuum deposited polyethylene terephthalate film or from a laminate film. From the viewpoint of light-intercepting property and appearance, the light-intercepting layer preferably is covered with a light-reflecting material such as titanium oxide. Various light-absorbing materials can be used in the light-intercepting layer. In particular, carbon powder (e.g., carbon black, etc.), silver colloid, organic polymers (e.g., azo lake, copper phthalocyanine, etc.), water-insoluble azo dyes, anthraquinone dye dispersions, polymers reacted with a reactive dye, micelle-forming hydrophilic dyes, etc. are useful.

The necessary light-intercepting ability of the light-intercepting layer used in the present invention varies depending upon the end-use purposes of the film unit. However, generally speaking, in many cases the layer should possess an absorbance (scattered light) of not less than about 3, preferably not less than 5 throughout the wavelength region of about 350 to 650 m$\mu$, preferably, about 300 to 750 m$\mu$. The dimensionally stable light-intercepting layer is advantageously used as an adhesive tape for intercepting light at the edges of a transparent support in order to prevent light leakage to the silver halide emulsion layers through the edges of the film unit.

The following examples are given to illustrate the present invention in greater detail. Unless otherwise indicated, all parts, percents, ratios and the like are by weight.

EXAMPLE 1

On a transparent cellulose triacetate film subbed with a gelatin layer were coated, in sequence, the following layers to prepare a light-sensitive element.

1. Cyan dye developer layer 1 part of 5,8-dihydroxy-1,4-bis[($\beta$-hydroquinonyl-$\alpha$-methyl)-ethylamino]anthraquinone was dissolved in 1.5 parts of N,N-diethyllaurylamide and 2.3 parts of 4-methylcyclohexanone. Then, this solution was emulsified and dispersed in a gelatin aqueous solution with the help of sodium n-dodecylbenzenesulfonate as a dispersing agent, and coated at a coverage of 1.4 g/m$^2$ of the dye, 1.7 g/m$^2$ of gelatin and 2.1 g/m$^2$ of N,N-diethyllaurylamide.

2. Red-sensitive silver halide emulsion layer

A red-sensitive silver bromoiodide emulsion (containing 1 mol% silver iodide) coated at a coverage of 2.3 g/m$^2$ of silver and 3.2 g/m$^2$ of gelatin.

3. Interlayer

A gelatin layer coated at a coverage of 3.0 g/m².

4. Magenta dye developer layer 1 part of 4-isopropoxy-2-[-(β-hydroquinonylethyl)-phenylazo]-1-naphthol was dissolved in 1.5 parts of N,N-diethyllaurylamide and 2.5 parts of 4-methylcyclohexanone. Then, this solution was emulsified and dispersed in a gelatin aqueous solution with the help of sodium n-dodecylbenzenesulfonate as a dispersing agent, and coated at a coverage of 0.80 g/m² of the dye, 1,3 g/m² of gelatin and 1.2 g/m² of N,N-diethyllaurylamide.

5. Green-sensitive silver halide emulsion layer

A green-sensitive silver bromoiodide emulsion (containing 2 mol% silver iodide) layer coated at a coverage of 1.0 g/m² of silver and 2.0 g/m² of gelatin.

6. Interlayer

A gelatin layer coated at a coverage of 3.0 g/m².

7. Yellow dye developer layer 1 part of 1-phenyl-3-(N-n-hexylcarbamoyl)-4-[p-(β-hydroquinonylethyl)phenylazo]-5-pyrazolone was dissolved in 1.5 parts of N,N-diethyllaurylamide and 2.5 parts of 4-methylcyclohexanone. Then, this solution was emulsified and dispersed in a gelatin aqueous solution with the help of sodium n-dodecylbenzenesulfonate as a dispersing agent and coated at a coverage of the dye of 0.70 g/m², 1.2 gm² of gelatin and 2.05 g/m² of N,N-diethyllaurylamide.

8. Blue-sensitive silver halide emulsion layer

A blue-sensitive silver bromoiodide emulsion (containing 7 mol% silver iodide) layer coated at a coverage of 0.50 g/m² of silver and 1.2 g/m² of gelatin.

9. Protective layer 1 part of 4'-methylphenylhydroquinone was dissolved in a mixture of 1 part by weight of tri-o-cresyl phosphate and 1 part of ethyl acetate. Then, this solution was emulsified and dispersed in a gelatin aqueous solution with the help of sodium n-dodecylbenzenesulfonate as an emulsifying agent, and coated at a coverage of 0.45 g/m² of 4'-methylphenylhydroquinone, 1.3 g/m² of gelatin and 0.45 g/m² of tri-o-cresyl phosphate using mucochloric acid as a hardening agent.

Then, on a gelatin-subbed transparent polyethylene terephthalate film were coated, in sequence, the following layers to prepare an image-receiving element.

1. Acidic polymer layer

A 20% methyl ethyl ketone solution of maleic anhydridevinyl methyl ether (1:1 monomer molar ratio) copolymer butyl half ester (mean molecular weight: about 100,000) was coated in a dry thickness of 20 μ.

2. Timing layer 1 part of 2-hydroxyethyl methacrylate was dissolved in a mixed solvent of 3 parts of acetone and 1 part of water, and coated in a dry thickness of 7 μ.

3. Image-receiving layer 1 part of poly-4-vinyl pyridine, and 2 parts of polyvinyl acetate (saponification degree: 98 mol%, polymerization degree: about 1,800) and 1/20 part of 1-phenyl-5-mercaptotetrazole were dissolved in 150 parts of water containing ½ part of glacial acetic acid, and this solution was coated at a coverage of 3.2 g/m² of poly-4-vinyl pyridine, and 3.2 g/m² of polyvinyl alcohol, and0.16 g/m² of 1-phenyl-5-mercaptotetrazole.

The thus prepared light-sensitive element was exposed from the opposite side to the support through an optical wedge having 20 steps (step difference: 0.2) and a gray, red, green or blue filter (Fuji Filter-ND, Fuji Filter SC-64, Fuji Filter BPN-53, Fuji Filter BPB-45, respectively) using a tungsten light having a color temperature of 2854° K. In this case, the maximum exposure amount was 20 C.M.S. Then, the following Processing Composition [A], [B] or [C] was spread between the protective layer of the light-sensitive element and the image-receiving layer of the image-receiving element in a dark room in an amount of 1.0 cc per 100 cm² of the light-sensitive element.

| Processing Composition (A) | |
|---|---|
| Water | 100 cc |
| Potassium Hydroxide | 11.2 g |
| Sodium Carboxymethyl Cellulose* | 3.5 g |
| Benzotriazole | 1.5 g |
| N-Benzyl-α-picolinium Bromide | 2.0 g |
| Titanium Dioxide | 50 g |

*"Selogen 3H", made by Dai-ichi Kogyo Seiyaku Co., Ltd.

Processing Composition (B)

A solution prepared by adding 0.83 g (2.0 m mol) of Compound (6) described hereinbefore to Processing Composition (A).

Processing Composition (C)

A solution prepared by adding 0.36 g (2.0 m mole) of 1-phenyl-5-mercaptotetrazole to Processing Composition (A).

After the completion of the development-processing, the composite was left without separating the light-sensitive element and the image-receiving element from each other. 10 minutes after the development processing, dye images were observed through the support of the image-receiving layer in a bright place to transfer according to the exposure amount and form gray, red, green and blue colors.

The resulting samples were left for 1 month in a room, during which the reflection density of the gray scale transferred images was measured using a Fuji Automatic Recording Densitometer. The results of the sensitometry were evaluated to obtain the following results. Results relating to the density at the high light areas are shown below.

| Processing Composition | | Time After Processing | | | | |
|---|---|---|---|---|---|---|
| | | 10 Min. | 1 Day | 3 Days | 10 Days | 30 Days |
| (A) | Blue | 0.23 | 0.28 | 0.31 | 0.34 | 0.40 |
| | Green | 0.24 | 0.26 | 0.27 | 0.29 | 0.34 |
| | Red | 0.23 | 0.24 | 0.27 | 0.29 | 0.34 |
| (B) | Blue | 0.24 | 0.24 | 0.25 | 0.26 | 0.29 |
| | Green | 0.24 | 0.24 | 0.26 | 0.29 | 0.34 |
| | Red | 0.23 | 0.23 | 0.26 | 0.28 | 0.34 |
| (C) | Blue | 0.65 | 0.67 | 0.69 | 0.72 | 0.73 |
| | Green | 0.40 | 0.42 | 0.45 | 0.46 | 0.48 |
| | Red | 0.31 | 0.32 | 0.33 | 0.37 | 0.40 |

Results relating to sensitivity are shown below (The sensitivity is shown in terms of the iogarithm (log E) of the exposure amount E necessary to obtain a density lower than the maximum dye density transferred to the image-receiving element by 0.2. Differences between the case of using Processing Composition (B) or (C) and the case of using Processing Composition (A) (Δ log E) are shown below. The minus values show that sensitivity was reduced as compared with the case of using Processing Composition (A).

| Processing Composition | Sensitivity Difference (Δ log E) | | |
|---|---|---|---|
| | Blue | Green | Red |
| (A) | 0 | 0 | 0 |
| (B) | −0.02 | +0.01 | +0.02 |
| (C) | −0.50 | −0.20 | −0.02 |

From the above results, it can be seen that Processing Composition (C) containing a low molecular weight mercapto compound, 1-phenyl-5-mercaptotetrazole, provided an unsatisfactorily high density at the high light areas and caused a greater desensitization with respect to the blue density and the green density as compared with Processing Composition (A). In contrast, Processing Composition (B) containing high molecular weight mercapto Compound (6 scarcely caused any desensitization and provided satisfactory results with respect to the density of the high light areas. A little difference in the blue density of the high light area was observed, immediately after processing, between using Processing Composition (A) and using Processing Composition (B). With the lapse of time after processing, a reduction, particularly in the blue density, i.e., 0.04 after 1 day, 0.06 after 3 days, 0.08 after 10 days and 0.09 after 30 days was observed. It can be seen that Compound (6) is excellent as an agent for preventing stain upon storage after processing.

On the other hand, Processing Composition (B) provided better color transferred images excellent in color separation upon storage as compared with Processing Composition (A).

EXAMPLE II

On a gelatin-subbed transparent cellulose triacetate film were coated, in sequence, the following layers to prepare a light-sensitive element (II).

1. Yellow dye developer layer 1 part of α-[p-(2′,5′-dihydroxyphenethyl)-phenylazo]-β-(2′-benzofuranyl)-β-methoxyacetoxyacrylonitrile was dissolved in 1 part of N,N-diethyllaurylamide and 4 parts of cyclohexanone, emulsified and dispersed in a gelatin aqueous solution with the help of sodium n-dodecylbenzenesulfonate, and coated at a coverage of 1.5 g/m² of the dye, 1.7 g/m² of gelatin, and 1.5 g/m² of N,N-diethyllaurylamide.

2. Blue-sensitive silver halide emulsion layer

A blue-sensitive silver bromoiodide emulsion (containing 2 mol% silver iodide) was coated at a coverage of 2.3 g/m² of silver and 1.7 g/m² of gelatin.

3. Interlayer

A layer of colloidal silver coated at a coverage of 0.3 g/m² of silver and 3.5 g/m² of gelatin.

4. Magenta dye developer layer 1 part of 1-acetoxy-2-[p-(2′,5′-dihydroxyphenethyl)-phenylazo]-4-[1″,4″-dioxahexyl]naphthalene was dissolved in 1 part of N,N-diethyllaurylamide and 4 parts of cyclohexanone, emulsified and dispersed in a gelatin aqueous solution with the help of sodium n-dodecylbenzenesulfonate, and coated at a coverage of 1.0 g/m² of the dye, 1.3 g/m² of gelatin and 1.0 g./m² of N,N-diethyllaurylamide.

5. Green-sensitive silver halide emulsion layer

A green-sensitive silver bromoiodide emulsion layer (containing 2 mol% silver iodide) spectrally sensitized with a sensitizing dye, 3,3′-9-triethyl-5,5′-diphenyloxacarbocyanine bromide was coated at a coverage of 1.0 g/m² of silver and 0.8 g/m² of gelatin.

6. Interlayer

A gelatin layer coated at a coverage of 3.0 g/m².

7. Cyan dye developer layer 1 part of 1,4-bis[(γ-hydroquinonyl)propylamino]-5,8,9,10-tetrahydroxyanthracene was dissolved in 0.8 part of polyvinyl acetate (polymerization degree: about 500) and 12 parts of cyclohexanone. Then, this solution was emulsified and dispersed in a gelatin aqueous solution with the help of sodium benzenesulfonate, and coated at a coverage of 0.80 g/m² of the dye, 1.1 g/m² of gelatin and 0.64 g/m² of polyvinyl acetate.

8. Red-sensitive silver halide emulsion layer

A silver bromoiodide emulsion layer (containing 2 mol% silver iodide) spectrally sensitized with a red-sensitive sensitizing dye, 3,3′-9-triethyl-5,5′-dichlorothiacarbocyanine iodide, was coated at a coverage of 0.50 g/m² of silver and 0.37 g/m² of gelatin. 9. Protective layer 1 part of 4′-methylphenylhydroquinone was dissolved in 1 part by weight of tri-o-cresyl phosphate and 1.5 parts of ethyl acetate, emulsified and dispersed in a gelatin aqueous solution with the help of sodium n-dodecylbenzenesulfonate, and coated at a coverage of 0.45 g/m² of 4′-methylphenylhydroquinone, 1.3 g/m² of gelatin and 0.45 g/m² of tri-o-cresyl phosphate. Mucochloric acid was used as a hardening agent.

The thus prepared light-sensitive element was exposed from the support side through an optical wedge having 20 steps (step difference: 0.2) using a tungsten light having a color temperature of 2854° K. In this case, the maximum exposure amount was 20 C.M.S. Then, the following Processing Compositions (A), (B), (D) to (G) were spread, respectively, between the protective layer of the light-sensitive element and the image-receiving layer of the image-receiving element (the same as in Example 1) in a dark room in an amount of 1.0 cc per 100 cm² of the light-sensitive element. Processing Composition (A): As described in Example 1. Processing Composition (B): As described in Example 1.

Processing Composition (D): A solution prepared by adding 0.43 g of Compound (2) to Processing Composition (A).

Processing Composition (E): A solution prepared by adding 1.1 g of Compound (7) to Processing Composition (A).

Processing Composition (F): A solution prepared by adding 0.69 g of Compound (12) to Processing Composition (A).

Processing Composition (G): A solution prepared by adding 0.70 g of Compound (14) to Processing Composition (A).

After conducting the same processing as in Example 1, the samples were left for 1 month in a room without separating the light-sensitive element and the image-receiving element from each other, during which time the reflection density of the transferred images was measured. Results relating to blue density at the high light areas are shown below.

| Processing Composition | Time After Processing | | | | |
|---|---|---|---|---|---|
| | 10 Min. | 1 Day | 3 Days | 10 Days | 30 Days |
| (A) | 0.25 | 0.30 | 0.37 | 0.42 | 0.45 |
| (B) | 0.22 | 0.23 | 0.25 | 0.28 | 0.28 |
| (D) | 0.24 | 0.26 | 0.28 | 0.33 | 0.35 |
| (E) | 0.23 | 0.26 | 0.27 | 0.32 | 0.33 |
| (F) | 0.23 | 0.24 | 0.27 | 0.29 | 0.30 |
| (G) | 0.25 | 0.26 | 0.27 | 0.31 | 0.32 |

From the above-described results, it can be seen that Processing Compositions (D) to (G) containing the stain-preventing agent provided a low blue density at the high light areas of the images as compared with Processing Composition (A), the difference in the blue density being 0.09 to 0.17 after 1 month. Thus, Compounds (2), (6), (7), (12), and (14) are extremely useful as a stain-preventing agent capable of reducing the yellowing of the images at the high light areas. On the other hand, Compound (6) used in Processing Composition (B) showed particularly remarkable effects in this Example.

Also, after 1 month, the increase in the density of the unnecessary absorptions of the transferred dye spectra in the case of using Processing Compositions (B), (D) to (G) was smaller than that in the case of using Processing Composition (A) by about 0.05 to 0.20. This shows that Compounds (2), (6), (7), (12) and (14) are useful as a stain-preventing agent capable of preventing a darkening of the transferred colors.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic material which comprises: (a) a light-sensitive element containing at least one silver halide emulsion layer having a dye image-providing material associated therewith; (b) an image-receiving element capable of imagewise fixing said dye image-providing material as a result of exposure and development of the silver halide emulsion layer; and (c) a processing composition capable of causing development of said silver halide emulsion layer and containing a mercapto compound having a molecular weight of about 230 or higher, said mercapto compound being a compound represented by the following general formula (I) or (II):

$$R^1 - SH \quad (I)$$

$$R^2 - SH \quad (II)$$

wherein $R^1$ represents an alkyl group having 14 to 32 carbon atoms or an aralkyl group having 15 to 32 carbon atoms, which can be substituted with a halogen atom, a nitro group, a carboxy group, a sulfo group, a cyano group, an alkoxy group, or an aryloxy group; $R^2$ represents a 3 - to 6 - membered carbocyclic group, a 3 - to 6-membered heterocyclic group containing at least one carbon atom and 1 to 5 atoms other than carbon atoms, or a B-A-group, and said carbocyclic group or hetero cyclic group can form a fused ring group and can be substituted with a halogen atom, a nitro group, a carboxy group, an aliphatic hydrocarbyl group having 1 to 32 carbon atoms, a monocyclic or bicyclic fused aryl group having 6 to 32 carbon atoms, an amido group having up to 32 carbon atoms, a carbamoyl group having up to 32 carbon atoms, an alkoxy group having up to 32 carbon atoms, or an aryloxy group having up to 32 carbon atoms; and, B represents the same alkyl group, aryl group, or heterocyclic group as defined with respect to $R^1$ to $R^2$; and A represents a carbonyl group, a thiocarbonyl group, or a carboxymethylene group, with the proviso that when A represents a carbonyl group or a thiocarbonyl group, B does not represent an amido group, a carbamoyl group or a carbonyl group with at least one of said light-sensitive element, said image-receiving element and said processing composition containing a developing agent for the silver halide which is a benzenoid developing agent capable of forming a quinoid structure upon being oxidized.

2. The color diffusion transfer photographic material as described in claim 1, wherein the developing agent for the silver halide emulsion is a compound having a dihydroxyphenyl group and an unsubstituted carbon atom in an ortho position to at least one of the hydroxy groups.

3. The diffusion transfer color photographic material as described in claim 1, wherein said dye image-providing material is a dye developer.

4. The diffusion transfer color photographic material as described in claim 1, wherein said dye image-providing material is a non-diffusible compound capable of releasing an alkali-soluble and diffusible dye upon reaction with an oxidation product of a developing agent.

5. The diffusion transfer color photographic material as described in claim 1, wherein the molecular weight of said mercapto compound is at least 300.

6. The diffusion transfer color photographic material as described in claim 1, wherein said mercapto compound is the compound represented by one of the following general formulae (III) to (IX);

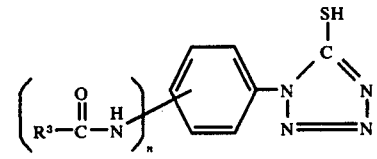
(III)

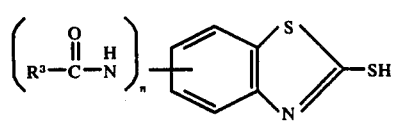
(IV)

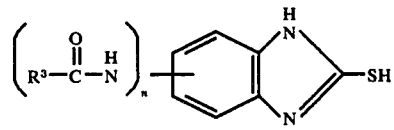
(V)

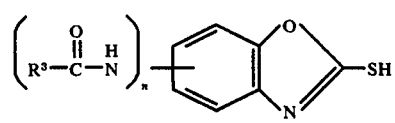
(VI)

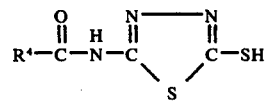
(VII)

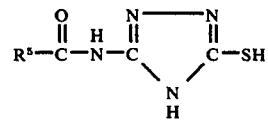
(VIII)

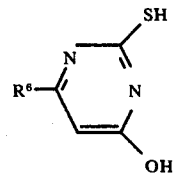
(IX)

wherein $R^3$ represents a hydrocarbyl group having 3 to 31 carbon atoms; $R^4$ represents a hydrocarbyl group having 5 to 31 carbon atoms; $R^5$ represents a hydrocarbyl group having 7 to 31 carbon atoms; $R^6$ represents a hydrocarbyl group having 8 to 32 carbon atoms; and *n* represents an integer of 1 to 5.

7. The diffusion transfer color photographic material as described in claim 1, wherein said mercapto compound is

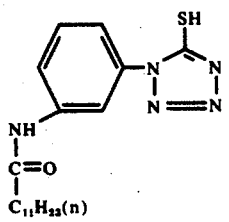

8. The diffusion transfer color photographic material as described in claim 1, including a nucleophilic agent capable of reacting with an oxidation product of a benzenoid developing agent.

9. The diffusion transfer color photographic material as described in claim 8, wherein said nucleophilic agent is a compound containing a methylene group active in an alkaline aqueous solution.

10. The diffusion transfer color photographic material as described in claim 8, wherein said nucleophilic agent is N-benzyl-α-picolinium bromide.

11. The diffusion transfer color photographic material as described in claim 8, wherein said nucleophilic agent is a nitrogen-containing saturated heterocyclic compound.

12. The diffusion transfer color photographic material as described in claim 1, wherein said mercapto compound is present in an amount of from about 0.01 to 50 mols per 1 mol of the developing agent.

* * * * *